US009849352B2

(12) United States Patent
Sander

(10) Patent No.: US 9,849,352 B2
(45) Date of Patent: Dec. 26, 2017

(54) GOLF CLUB HEAD STRUCTURES HAVING SPLIT, MULTI-PART HEADS

(71) Applicant: NIKE, Inc., Beaverton, OR (US)

(72) Inventor: Raymond J. Sander, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/815,213

(22) Filed: Jul. 31, 2015

(65) Prior Publication Data

US 2015/0335964 A1 Nov. 26, 2015

Related U.S. Application Data

(62) Division of application No. 13/834,759, filed on Mar. 15, 2013, now Pat. No. 9,126,085.

(51) Int. Cl.
*A63B 53/04* (2015.01)

(52) U.S. Cl.
CPC .. *A63B 53/0466* (2013.01); *A63B 2053/0408* (2013.01)

(58) Field of Classification Search
CPC ..... A63B 53/0466
See application file for complete search history.

(56) References Cited

U.S. PATENT DOCUMENTS 3,941,390 A 3/1976 Hussey
5,706,566 A 1/1998 Igarashi
7,156,750 B2 * 1/2007 Nishitani ..... A63B 53/0466 473/329
7,399,238 B2 7/2008 Hocknell et al.
8,133,128 B2 3/2012 Boyd et al.
8,444,504 B2 5/2013 Chao et al.
2003/0064825 A1 4/2003 Sano
2006/0052174 A1 3/2006 Williams
2006/0128500 A1 6/2006 Tavares
(Continued)

FOREIGN PATENT DOCUMENTS

CN 101237788 A 8/2008
CN 201208490 Y 3/2009
(Continued)

OTHER PUBLICATIONS

International Search Report and Written Opinion dated Sep. 4, 2014 for PCT Application No. PCT/US2014/028699.

*Primary Examiner* — Michael Dennis

(57) ABSTRACT

Golf club heads include at least one part having a side wall extending completely around the golf club head, wherein the side wall ends at an edge (a free end) that defines an open side of the part. An interior surface of this side wall has a draft angle of −1° or more as it extends to its edge. In some club heads, the interior surface of at least one club head part will be shaped so that the interior surface does not converge as the side wall of that part extends to its edge. For some club head parts, the planar cross sectional area defined inside the interior surface of the part will either stay the same or get larger as one moves to the part edge. By avoiding or limiting features of negative draft angles, converging interior surfaces, and/or smaller cross sectional areas on interior surfaces of a part, manufacturing and tooling may be simplified.

18 Claims, 18 Drawing Sheets

(56) References Cited

U.S. PATENT DOCUMENTS

| | | | | |
|---|---|---|---|---|
| 2008/0076597 | A1 | 3/2008 | Roach et al. | |
| 2008/0153621 | A1 | 6/2008 | Rollinson et al. | |
| 2008/0242445 | A1* | 10/2008 | Mergy | A63B 53/0466 473/345 |
| 2009/0088272 | A1* | 4/2009 | Foster | A63B 53/0466 473/350 |
| 2009/0312118 | A1 | 12/2009 | Deshmukh et al. | |
| 2010/0203983 | A1 | 8/2010 | Stites | |
| 2011/0009211 | A1* | 1/2011 | Chao | A63B 53/0466 473/342 |
| 2011/0070973 | A1 | 3/2011 | Oldknow et al. | |

FOREIGN PATENT DOCUMENTS

| | | | |
|---|---|---|---|
| GB | 2429410 | A | 2/2007 |
| GB | 2448023 | A | 10/2008 |
| JP | S5047270 | U | 5/1975 |
| JP | S5919165 | Y2 | 6/1984 |
| JP | H05303413 | A | 11/1993 |
| JP | H06170019 | A | 6/1994 |
| JP | H1076030 | A | 3/1998 |
| JP | H11313906 | A | 11/1999 |
| JP | 2003144590 | A | 5/2003 |
| JP | 2003230643 | A | 8/2003 |
| JP | 2004216131 | A | 8/2004 |
| WO | 2006063468 | A1 | 6/2006 |
| WO | 2012075178 | A1 | 6/2012 |
| WO | 2012149385 | A1 | 11/2012 |

* cited by examiner

GOLF CLUB HEAD STRUCTURES HAVING SPLIT, MULTI-PART HEADS

CROSS-REFERENCE TO RELATED APPLICATIONS

This divisional application claims priority to pending U.S. patent application Ser. No. 13/834,759 filed Mar. 15, 2013 entitled "Golf Club Head Structures Having Split, Multi-Part Heads", the contents of which are all incorporated herein in its entirety.

FIELD OF THE INVENTION

The present invention relates generally to golf clubs and golf club heads. Particular example aspects of this invention relate to golf club heads having a split, multi-part golf club head.

BACKGROUND

The Rules of Golf include several requirements controlling features of golf club heads, including limitations on club head sizes, groove structures, face flexibility, and other features. Over the years, new golf club head structures have been developed in an effort to enhance club performance and to produce club heads having performance characteristics at the extreme limits allowed by the Rules of Golf. As a result, many golf club heads are made from multiple parts and materials that are manufactured in complicated and costly processes with relatively tight manufacturing tolerances. Accordingly, golf club head designs and/or manufacturing methods that reduce complexity and costs associated with the manufacturing golf club products would be a welcome advance in the art.

SUMMARY OF THE INVENTION

The following presents a simplified summary of various aspects and features of the invention in order to provide a basic understanding of the invention. This summary is not an extensive overview of the invention. It is neither intended to identify key or critical elements of the invention nor to delineate the scope of the invention. The following summary merely presents some concepts relating to the invention in a simplified form as a prelude to the more detailed description below.

Golf club heads, and particularly wood-type golf club heads (e.g., drivers, fairway woods, wood-type hybrid clubs, or the like), according to at least some example aspects of this invention include: a multi-part club head that includes at least one part having a side wall extending around the golf club head (e.g., a side wall extending completely around a crown, a heel side, a sole, and a toe side of the golf club head), wherein the side wall ends at an edge (a free end) that defines an open side of the part. An interior surface of this side wall has no negative draft angle (e.g., over its interior length and perimeter) as it extends in a direction toward the edge (e.g., in a first pulling direction). In other words, this interior surface has a draft angle of 0° or more (e.g. with respect to a mold tool pulling direction) as the interior surface extends toward the edge. The interior surface of the side wall may have a positive draft angle throughout its length and around its entire perimeter as it extends toward the edge, or it may have a neutral (0°) draft angle for one or more portions of its length and/or perimeter and a positive draft angle at the remaining portions of its length and/or perimeter. Some golf club head structures in accordance with this invention will have two or more individual parts having draft angles of 0° or more on their interior surfaces of the types described above. For golf club head structures having multiple parts, any number of the individual parts may have interior surfaces with draft angles of 0° or more, including all or fewer than all of the parts. While not a requirement, if desired, the exterior surface(s) of one or more of the parts also may have draft angles of 0° or more (and optionally, a positive draft angle) throughout its length and/or perimeter.

In accordance with some examples of this invention, the interior surface of one or more club head parts that ends at an edge that defines an open side of the part will be shaped such that the interior surface of the side wall of that part does not converge as the side wall extends in a direction toward the edge (toward the open side (or one open side) of the part).

Additionally or alternatively, in some structures, one or more of the parts of the club head will be shaped such that a series of parallel cross sectional planes are defined at locations along the part in which the interior surface of the side wall of the part defines an uninterrupted interior perimeter surface. In some parts of golf club head structures in accordance with this aspect of the invention, for any individual plane of this series of parallel cross sectional planes: an area defined within the interior surface of the side wall for that individual plane is equal to or less than an area defined within the interior surface of the side wall for any plane of this series of parallel cross sectional planes located closer to the edge than that individual plane. In other words, for some parts in golf club head structures according to this aspect of the invention, the planar cross sectional area defined inside the interior surface of the part will either stay the same or get larger as one moves toward the open edge (or one open edge) of the part.

By avoiding negative draft angles, converging interior surfaces, and/or smaller cross sectional areas on interior surfaces of a part moving toward its open end, the part may be manufactured in a relatively simple and straightforward manner, typically without the need for complicated tooling. As some more specific examples, at least some of the parts may be made by molding processes (e.g., injection molding), wherein the need to mold the part in a multi-step process, the need to use removable mold cores, the need to use molds with several pieces or parts, the need for repeated operator interaction during the molding process, and the like, may be avoided.

Additional aspects of the invention relate to golf club heads formed with two parts, wherein interior side walls of each part have a positive (or neutral) draft angle in a direction moving toward the position of the parting line between the parts. Thus, the location and path of the parting line between adjacent parts may be irregular, but it has a shape that allows the interior surface of each part to have a positive draft angle. The parting line may trace locations along the crown, sole, and sides of the golf club head at which the shape of the curve of the interior surface of the club head changes from a positive slope to a negative slope (e.g., at an inflection point along the interior surface).

In another aspect of the invention, a golf club head may be formed from three or more parts wherein at least two of the parts provide a positive (or neutral) draft angle along the interior surface of the part in a direction moving toward an edge of that part. In yet another aspect of the invention, a golf club head may be formed by n parts, wherein and at least two of the n parts (and, optionally, up to all of the n parts) provide an interior surface having a positive (or neutral) draft angle.

If desired, golf club head parts according to at least some examples of this invention may be made from polymer materials, e.g., by a molding process (such as injection molding). In further aspects of this invention, if desired, the golf club head (e.g., the front part and/or the back part) may then be at least partially covered with a nano coating of another material, optionally after the various parts are connected to one another, e.g., to conceal the joint and provide the appearance of a one-piece golf club head or a golf club head formed of a single material. The nano coating may cover all or substantially all of the golf club head. Additionally or alternatively, if desired, the molded polymer part(s) may serve as a base member to which other club components may be attached, such as a ball striking face plate, a cup face, a crown plate, a sole plate, a medallion, one or more weight members, etc. A description of applying nano-coatings is found in co=pending application U.S. patent application Ser. No. 13/592,418 filed Aug. 23, 2012 which is hereby incorporated by reference in its entirety.

Additional aspects of this invention relate to methods of designing a multi-part golf club head and/or molds for forming the multi-part golf club head, wherein at least a portion of one parting line between parts of the golf club head (and optionally an entire parting line extending completely around the golf club head from top to bottom) is selected so as to lie along a continuous line around the club head body at which the interior surface of the club head's side wall changes from a positive slope to a negative slope and/or at which the interior surface is flat (wherein the positive to negative slope change occurs at the ends of a flat portion). Portions of these design processes may include determining locational features of the parting line to separate the club head into two or more parts with interior surfaces of the types described above. Molds may be designed based on the part designs as described above.

Still additional aspects of this invention relate to methods of making multi-part golf club heads of the types described above. Such methods may include molding polymeric or other materials for one or more parts of the golf club head to have interior surfaces with draft angles of 0° or more, as described above, e.g., so that the part(s) can be made from a mold in a single step molding operation and/or without the need to alter features of the interior of the mold (e.g., the mold inner core) during the molding operation. The entire interior surface of the mold cavity can be pulled away from the interior surface of the molded golf club head part as a single piece in a single and continuous mold pulling operation (i.e., the operation in which the mold tooling part is pulled out of a cavity or recess formed in the molded part).

Additional aspects of this invention relate to golf club structures that include golf club heads, e.g., of the types described above. Such golf club structures further may include one or more of: a shaft member attached to the club head (optionally via a separate hosel member or a hosel member provided as an integral part of one or more of the club head parts); a grip or handle member attached to the shaft member; additional weight members; etc. Still, additional aspects of this invention relate to club heads in which one or more parts may have a small negative draft angle on its interior surface, e.g. draft angles of −0.1° or more. The negative draft angle areas, when present on one or more parts, may extend less than a full perimeter length and/or less than a full front-to-back depth of the interior surface.

BRIEF DESCRIPTION OF THE DRAWINGS

The present invention is illustrated by way of example and not limited in the accompanying figures, in which like reference numerals indicate similar elements throughout, and in which.

The reader is advised that the various parts shown in these drawings are not necessarily drawn to scale.

DETAILED DESCRIPTION

The following description and the accompanying figures disclose features of golf clubs and golf club head structures in accordance with examples of the present invention, as well as features for designing and making golf club heads and equipment for making golf club heads in accordance with examples of this invention. When the same reference number appears in more than one drawing, that reference number is used consistently in this specification and the drawings to refer to the same or similar parts throughout.

Aspects and features of this invention as described herein may be used with various types of golf club heads, including, for example wood-type golf heads, e.g., club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). Additionally, aspects and features of this invention may be used with other club heads having a hollow interior (e.g., putters with a hollow base).

Figure 1A:
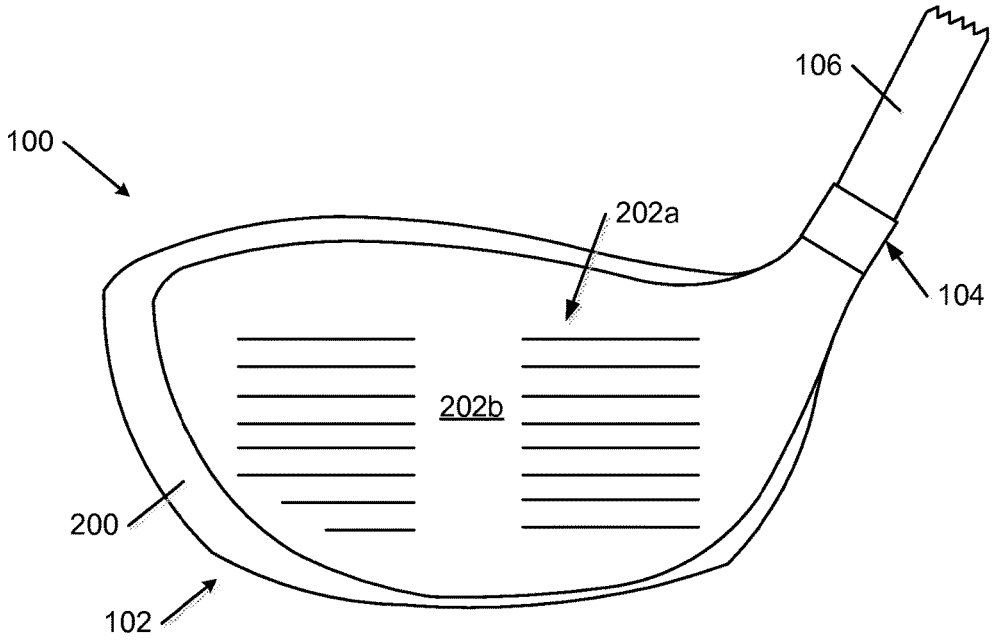
FIGS. 1A through 1C provide various views of an example golf club having a multi-part golf club head according to at least some examples of this invention.
Figure 1B:
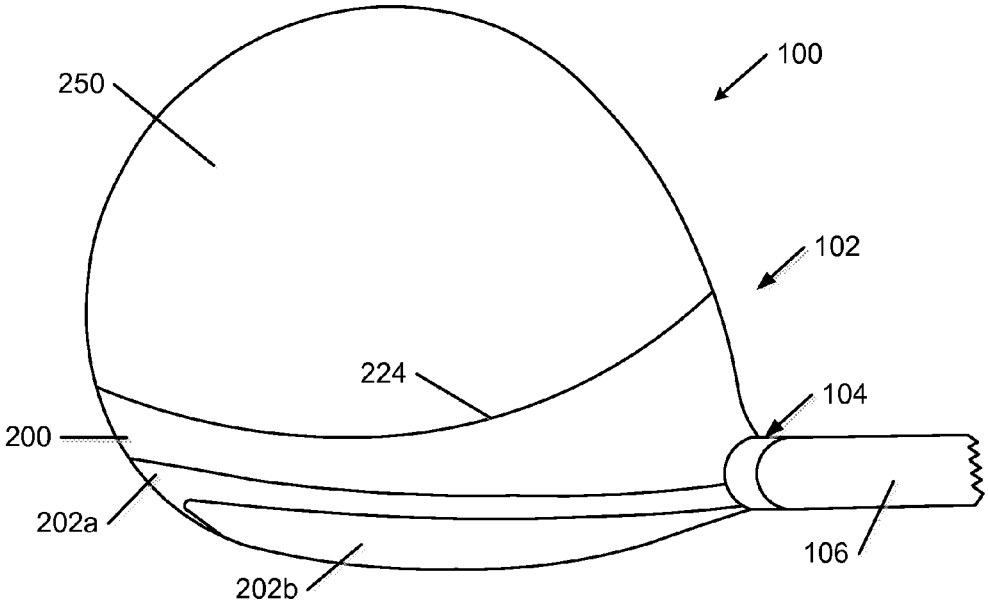
Figure 1C:
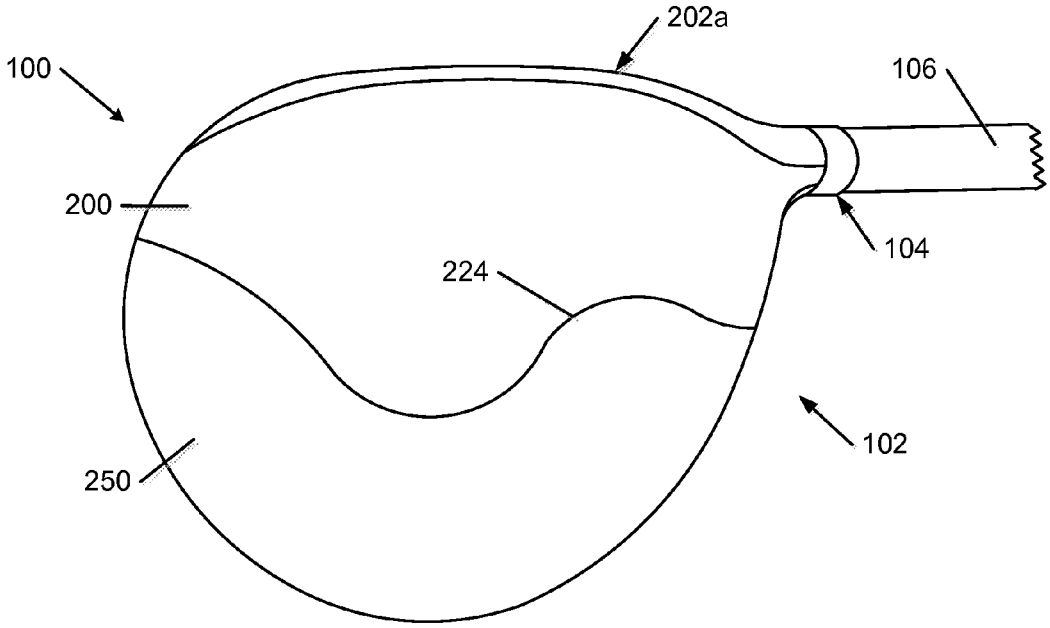

FIGS. 1A through 1C provide various views of an example golf club 100 including a golf club head 102 in accordance with one example of this invention. In addition to the golf club head 102, the overall golf club structure 100 of this example includes a hosel 104, a shaft 106 received in and/or inserted into and/or through the hosel 104, and a grip or handle (not shown) attached to the shaft 106. Optionally, if desired, the external hosel 104 may be eliminated and the shaft 106 may be directly inserted into and/or otherwise attached to the head 102 (e.g., through an opening or recessed bore provided in the top of the club head 102, through an internal hosel (e.g., provided within an interior chamber defined by the club head 102), etc.). The hosel 104 (or portions thereof) may be integrally formed in the processes described below, or it may be one or more separate parts attached to one or more parts of the overall club head structure.

The shaft 106 may be received in, engaged with, and/or attached to the club head 102 and/or hosel 104 in any suitable or desired manner, including in conventional manners known and used in the art. As more specific examples, the shaft 106 may be engaged with the club head 102 via the hosel 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft/club head connection also may be releasable and adjustable, e.g., in any desired manner including manners as are known and used in the art. The shaft 106 also may be made from any suitable or desired materials, including conventional materials known and used in the art, such as graphite based materials, composites or other non-metal materials, steel materials (including stainless steel), aluminum materials, other metal or metal alloy materials, polymeric materials, combinations of various materials, and the like. Also, the grip or handle may be attached to, engaged with, and/or extend from the shaft 106 in any suitable or desired manner, including in conventional manners known and used in the art, e.g., using adhesives or cements; via welding, soldering, or the like; via mechanical connectors (such as threads, retaining elements, etc.); etc. As another example, if desired, the grip or handle may be integrally formed as a unitary, one-piece construction with the shaft 106. Additionally, any desired grip or handle materials may be used without departing from this invention, including, for example: rubber materials, leather materials, rubber or other materials including cord or other fabric material embedded therein, polymeric materials, and the like.

The club head 102 itself (or at least parts thereof) also may be constructed from any suitable or desired materials without departing from this invention, including from conventional materials and/or in conventional manners known and used in the art. In some more specific examples of this invention, at least some portions of this club head 102 will be formed from a molded material, such as a molded polymeric material, in a manner and in a construction as will be described in more detail below.

The example golf club head structure 102 shown in FIGS. 1A through 1C includes a front part 200 having a front portion 202*a* that may include a ball striking face 202*b*. While the entire front part 200 may be formed as a unitary, one piece construction, if desired, the front portion 202*a* may be constructed as a frame member integral with the remainder of the front part 200, and the front portion 202*a* may be formed to include ledges or other structures to which a separate ball striking face plate 202*b* is attached. As another example, if desired, the front part 200 may constitute a separately formed base part to which a cup face or other member (e.g., including front portion 202*a* and ball striking face 202*b*) is connected (e.g., using adhesives or cements, welding or other fusing techniques, mechanical connectors, etc.).

This example club head 102 also includes a rear part 250 arranged behind (i.e., horizontally rearwardly and optionally immediately adjacent to) the front part 200 when the club head 102 is in a ball-address position. At least one of the rear part 250 or the front part 200 may be designed and made by the methods described in more detail below. However, if desired, any one or more individual parts of an overall club head structure 102 in accordance with this invention may be formed from known methods of manufacture, such as casting, forging, molding, etc., provided at least one part has at least some of the features and characteristics of the invention as will be discussed more fully below. In some examples, the front part 200 and the rear part 250 may be formed using different manufacturing processes and/or different materials, although they may be made using the same processes and/or the same materials, if desired. The club head 102 of this example includes a crown or top portion and a sole or bottom portion, with those portions optionally joined by heel and toe side portions or walls, rear portions or walls, the front portion 202*a*, and the like. The club head 102 defines a hollow interior.

As further shown in FIGS. 1B and 1C, the front part 200 of the multi-part golf club head 102 is positioned horizontally adjacent to and in contact with the rear part 250, e.g., at parting line 224 (when the club head 102 is soled and/or oriented in a ball address position). The parting line 224 extends continuously around the head 102 from the top (crown) portion, around the toe portion or side, around the bottom (sole) portion, around the heel portion or side, and back to the top portion. In this illustrated example (see FIG. 1B), the top portion of parting line 224 generally has a curve to form a concave top edge on the front part 200 and a convex top edge on rear part 250. FIG. 1C shows that the bottom portion of parting line 224 generally has a contoured (e.g., somewhat sinusoidal) design. Features regarding the location and shape of the parting line 224 will be described in more detail below in conjunction with FIGS. 3A-4E.

Figure 2A:
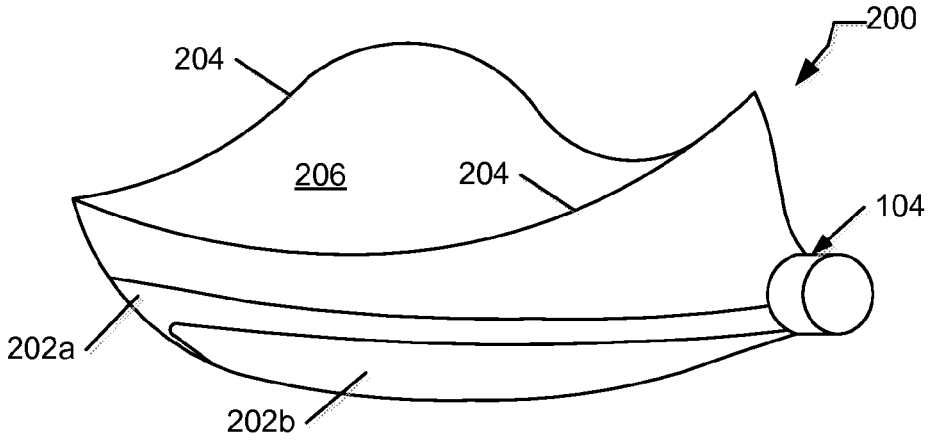
FIGS. 2A and 2B illustrate top and bottom views, respectively, of the front part of one example split multi-part golf club head.
Figure 2B:
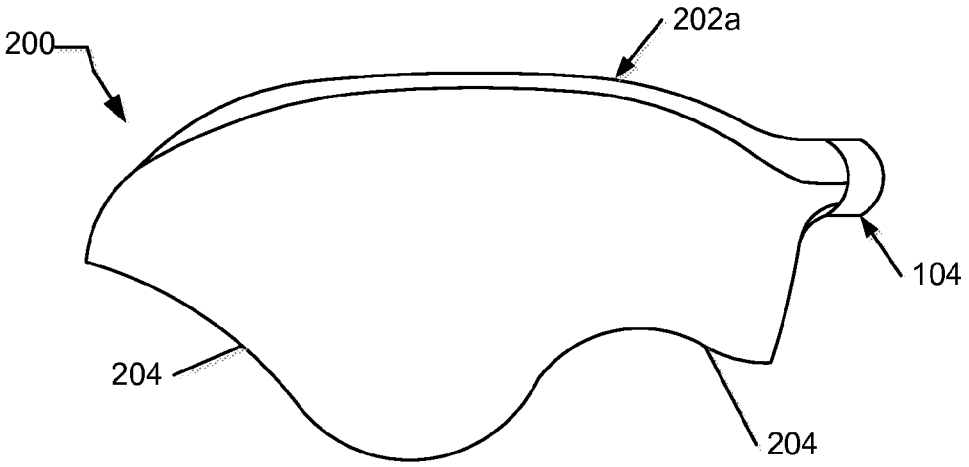

FIGS. 2A and 2B illustrate top and bottom views, respectively, of a front part 200 of a split, multi-part golf head 102 like that shown in FIGS. 1A-1C. As is evident from these figures, the front part 200 is formed to include side walls that extend in a rearward direction (along the crown, sole, toe, and heel areas of the front part 200) and, in at least some areas, define a continuous surface around the front part 200. The front part 200 of this example includes a closed forward end (including front portion 202*a* and ball striking face 202*b*), although, as noted above, this forward end could be open if desired, and another separate part (e.g., a cup face, a ball striking face plate, etc.) may be engaged at the front of the forward end of front part 200 to close off the part 200. The continuous surface around the front part 200 of this example (extending from the crown to sole around the heel and toe sides) ends at a rearward edge 204 that defines an open side of the first part 200. The rearward edge 204 may be in the general shape of the parting line 224 of the finished club head. The open side defined by the rearward edge 204 provides an opening through which a mold part is removed from the molded golf club head part 200, as will be described in more detail below. As also will be explained in more detail below, the interior surface 206 of the side wall of this first part 200 has no negative draft angle as it extends in a direction (in the mold pulling direction) toward the rear edge 204. If desired, the interior surface 206 of the side wall of the first part 200 may have a positive draft angle through a majority, or even all, of its rearward extent toward edge 204.

Figure 2C:
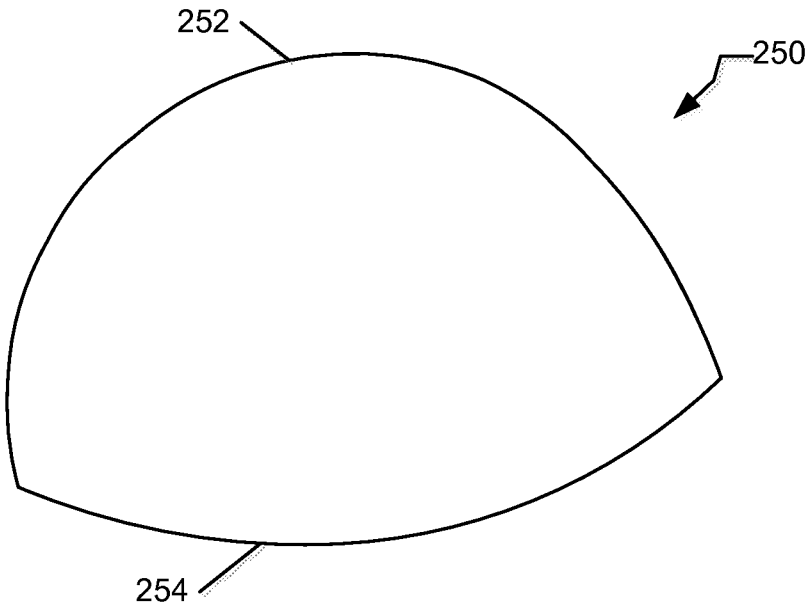
FIGS. 2C and 2D illustrate top and bottom views, respectively, of the rear part of this example golf club head.
Figure 2D:
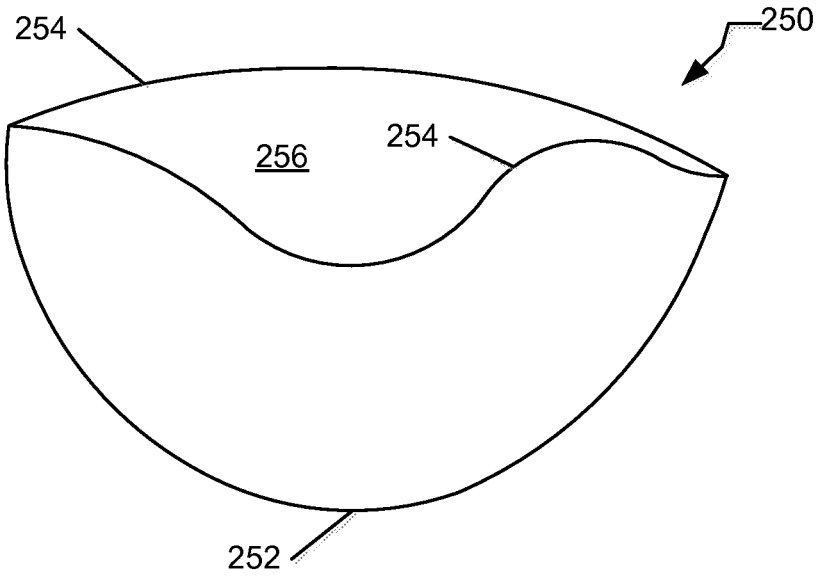

FIGS. 2C and 2D illustrate top and bottom views, respectively, of a rear part 250 of a split, multi-part golf head 102 like that shown in FIGS. 1A-1C. As is evident from these figures, the rear part 250 is formed to include side walls that extend in a forward direction (along the crown, sole, toe, and heel areas of the rear part 250) and, in at least some areas, define a continuous surface around the rear part 250. The rear part 250 of this example includes a closed rearward end 252, although, if desired, the rear portion of rear part 250 may include a surface or structure to which another club head part is engaged. The continuous surface around the rear part 250 of this example (extending from the crown to sole around the heel and toe sides) ends at a forward edge 254 that defines an open side of the second part 250. The forward edge 254 may be in the general shape of the parting line 224 of the finished club head. The open side defined by the forward edge 254 provides an opening through which a mold part is removed from the molded golf club head part 250, as will be described in more detail below. As also will be explained in more detail below, the interior surface 256 of the side wall of this second part 250 has no negative draft angle as it extends in a direction (in the mold pulling direction) toward the forward edge 254. If desired, the interior surface 256 of the side wall of the second part 250 may have a positive draft angle through a majority, or even all, of its forward extent toward edge 254.

The parting line 224 depicted in FIGS. 1B and 1C are just examples of a location and path for one club head example according to the present invention. The location and path of the parting line 224 may be irregular and dependent at least in part on the shape of the interior surface of the desired golf club head design. The parting line 224 shape is selected in this example to ensure that the interior surfaces 206, 256 of each part identified in FIG. 2A through FIG. 2D has a positive (or neutral) interior draft angle as will now be discussed in conjunction with FIGS. 3A through 4F. Any number of parts may be used in golf club heads in accordance with some examples of this invention as long as at least one part (and optionally more parts up to all parts of the club head body) has an interior surface with a positive or neutral draft angle. The part(s) having interior surface(s) with a positive or neutral draft angle as the surface extends toward one outermost open edge may be molded using uncomplicated equipment, such as molds having a static or single core, and these parts may be molded in a simple process, optionally a single step process. Also, while it may be advantageous to use such uncomplicated molds, tools, and processes, any suitable equipment may be used to prepare the parts, if desired, provided one or more of the club head parts have one or more of the interior surface characteristics as described herein.

Figure 3A:
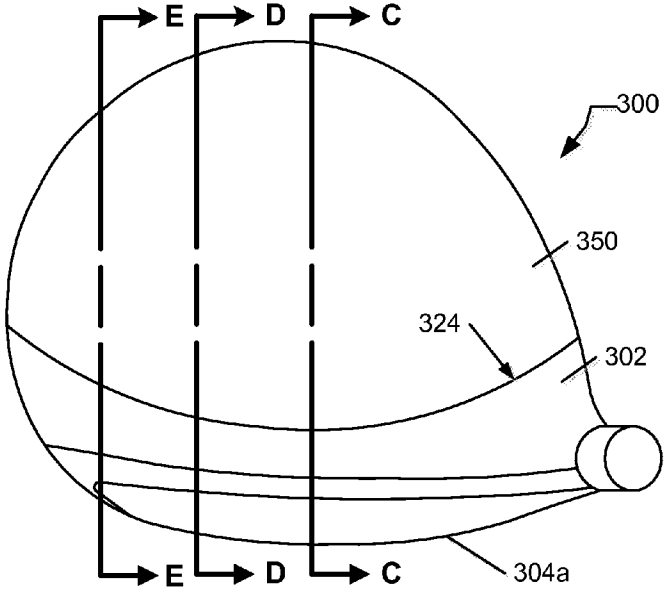
FIGS. 3A to 3G provide various views of a multi-part golf club head having two parts and a single parting line to assist in illustrating and describing various features of this invention.
Figure 3B:
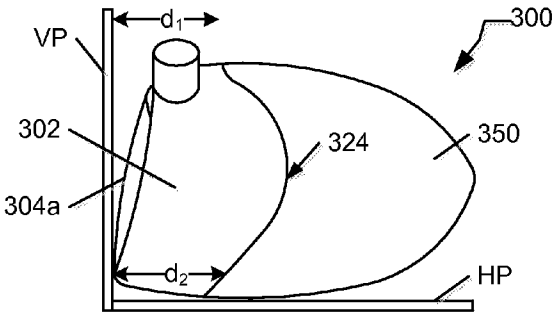

FIGS. 3A and 3B depict a two part club head 300 similar to the club head 102 depicted in FIGS. 1A through 1C, including a front part 302 and a separate rear part 350, and having an irregular parting line 324 extending around the club head 300, from top-to-bottom, between these two parts 302, 350. Lines indicated by C-C, D-D, and E-E indicate cross-sections of the club head depicted in FIGS. 3C, 3D, and 3E, respectively. For discussion and orientation purposes, two planes are illustrated in FIG. 3B, namely a horizontal plane HP (which defines a contact surface on which the club head 300 can be soled to define a "ball address position") and a vertical plane VP perpendicular to the horizontal plane HP. The vertical plane VP also is located and oriented at a forwardmost tangent point or edge of the front face 304*a* of the golf club head 300 to define a base location for rearward measurements in FIGS. 3C-3E. FIG. 3B also defines a general dimension $d_1$, located at the crown or top half of the club head 300, as the dimension from the vertical plane VP to the crown or top half portion of the parting line 324, and a general dimension $d_2$, located at the sole or bottom half of the club head 300, as the dimension from the vertical plane VP to the sole or bottom half portion of the parting line 324.

Figure 3C:
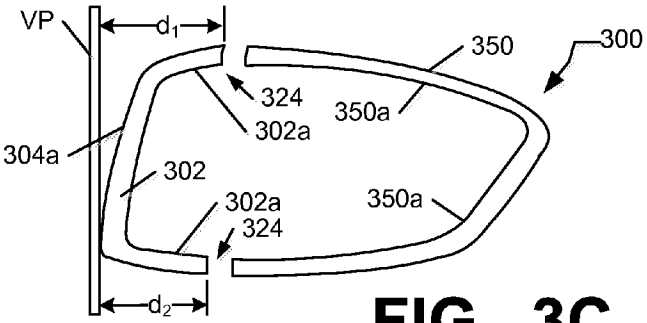
Figure 3D:
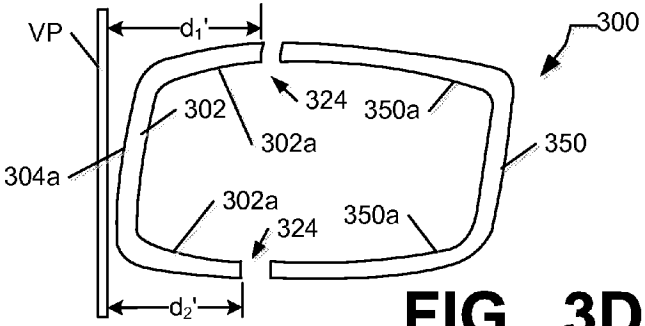
Figure 3E:
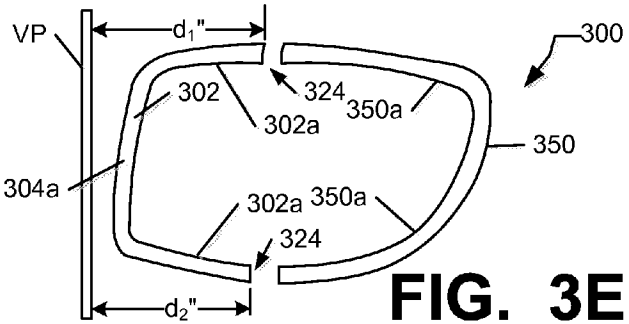

As shown in FIGS. 3C, 3D, and 3E, the dimensions (rearward lengths) from the vertical plane VP to the parting line 324 at the top or top half of the club head 300 are depicted by $d_1$, $d_1'$, and $d_1''$ respectively, and dimensions (rearward lengths) from the vertical plane VP to the parting line 324 at the bottom or bottom half of the club head 300 are depicted by $d_2$, $d_2'$, and $d_2''$ respectively. Due to the irregular or curved contours of the parting line 324, the dimension $d_1$ need not (and in most instances will likely not) be equal to $d_1'$, $d_1''$, . . . $d_1^{n}$. Similarly, $d_2$ need not (and in most instances likely will not) be equal to $d_2'$, $d_2''$, . . . $d_2^{n}$. Similarly dimension $d_1$ need not be equal to $d_2$, dimension $d_1'$ need not be equal to $d_2'$, and dimension $d_1''$ need not be equal to $d_2''$, etc., at any given cross sectional location (although at least some of these dimensions may be equal, at least at some locations).

The position of the parting line 324 (and thus the differences, if any, in dimensions $d_1$ and/or $d_2$) of this example club head structure depends on the three dimensional shape of the parts 302, 350 (or more) that make up the club head 300 (at least the shapes of their interior surfaces). As shown by the cross sectional views of FIGS. 3C-3E, the interior side wall 302*a* of front part 302 of this example diverges outward or slants away from the interior space defined by the part 302 as the wall 302*a* extends toward its parting line 324 edge. Likewise, as shown in these figures, the interior side wall 350*a* of rear part 350 diverges outward or slants away from the interior space defined by the part 350 as the wall 350*a* extends toward its parting line 324 edge. Rather than divergent, the side walls 302*a* and/or 350*a* may extend straight rearward over at least some portions of their length, provided the interior side walls 302*a*, 350*a* do not converge or slant inward toward their respective interior spaces as the walls 302*a*, 350*a* extend toward their respective outer edges. Interior walls 302*a*, 350*a* of this type provide a positive (or optionally partially neutral) interior draft angle for the interior walls 302*a*, 350*a*. Providing a positive (or even partially neutral) draft angle on the interior walls of a club head part makes it easier to remove the mold from the part after the part is made and simplifies the molding procedure, as will be described in more detail below. Stated more simply, this feature allows the mold part for forming the interior surface of the part to be pulled rearwardly out of rear edge of the part (the mold "pulling' direction) and away from the interior walls 302*a*, 350*a* without the mold interior surface contacting or hanging up on the interior walls 302*a*, 350*a* of the molded part.

Figure 3F:
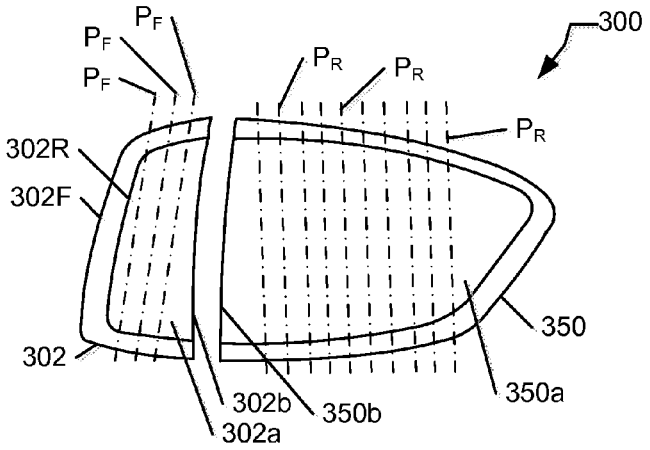
Figure 3G:
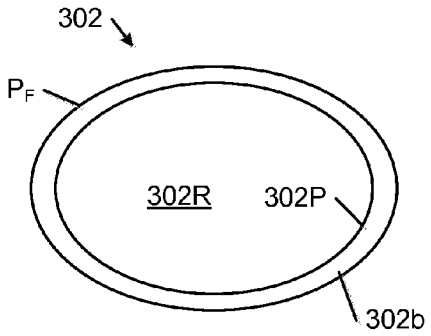

FIGS. 3F and 3G illustrate additional potential features of golf club head parts having interior walls or surfaces with positive or even partially neutral draft angles throughout the walls' extent to its open edge. As shown in FIG. 3F, the club head 300 (shown in cross section) includes a forward part 302 and a rearward part 350. The forward part 302 includes a side wall extending around the golf club head 300 (e.g., continuously from the top, around the sides, and to the bottom). The interior surface 302*a* of the side wall ends at an edge 302*b* that defines an open side of the forward part 302. A series of parallel cross sectional planes $P_F$ may be defined at locations along the forward part 302 in which the interior surface 302*a* of the side wall defines an uninterrupted interior perimeter surface 302P completely around the cross section (FIG. 3G shows a view of the forward part 302 looking from the direction of the open edge 302*b* of part 302 toward the rear surface 302R of the front face 302F to help illustrate uninterrupted perimeter surface 302P). Planes $P_F$ in this figure are oriented perpendicular to a direction D, in which a tooling part (e.g. a portion of a mold) is pulled from the club head part 302 when the part 302 is being made. Some parts for club heads in accordance with examples of this invention may be shaped such that, for any individual plane of the series of parallel cross sectional planes $P_F$: an area defined within the interior surface of the side wall 302*a* for that individual plane (i.e., the area inside perimeter surface 302P of FIG. 3G) is equal to or less than an area defined within the interior surface of the side wall 302*a* for any plane of the series of parallel cross sectional planes $P_F$ located closer to the open edge 302*b* than the first individual plane. In other words, the planar area enclosed by the internal perimeter surface 302P of part 302 does not decrease (and may be equal or increase) as the side wall 302*a* moves rearward toward the edge 302*b* (e.g., in direction $D_1$).

As further shown in FIG. 3F, the rearward part 350 of the club head 300 also includes a side wall extending around the golf club head 300 (e.g., continuously from the top, around the sides, and to the bottom). The interior surface 350*a* of the side wall ends at an edge 350*b* that defines an open side of the rearward part 350. A series of parallel cross sectional planes $P_R$ may be defined at locations along the rearward part 350 in which the interior surface 350*a* of the side wall defines an uninterrupted interior perimeter surface completely around the cross section (this uninterrupted interior perimeter surface would appear similar to surface 302P shown in FIG. 3G). Planes $P_R$ are oriented perpendicular to a direction $D_2$ in which a tooling part (e.g. a portion of a mold) is pulled from the club head part 350 when the part 350 is being made. Some parts for club heads in accordance with examples of this invention may be shaped such that, for any individual plane of the series of parallel cross sectional planes $P_R$: an area defined within the interior surface of the side wall 350*a* for that individual plane (i.e., the area inside perimeter surface) is equal to or less than an area defined within the interior surface of the side wall for any plane of the series of parallel cross sectional planes $P_R$ located closer to the open edge 350*b* than the first individual plane. In other words, the planar area enclosed by the internal perimeter surface of part 350 does not decrease (and may be equal or increase) as the side wall 350*a* moves forward toward the edge 350*b*.

For golf club parts in accordance with at least some examples of this invention, the features described above in conjunction with FIGS. 3F and 3G will hold for parallel cross sectional planes at any angle or orientation that passes through the crown and sole portions of the part, provided the interior surface of the part forms a continuous and complete perimeter around the interior wall surface of the cross sectional plane at that angle or orientation. When two or more parts of a club head construction have these interior surface characteristics, the planes on one part (e.g., $P_F$) and may be, but need not be, parallel to the planes on the other part (e.g., $P_R$). FIG. 3F shows planes $P_F$ and $P_R$ (and the perpendicular pulling directions $D_1$ and $D_2$) as being non-parallel to one another.

Figure 4A:
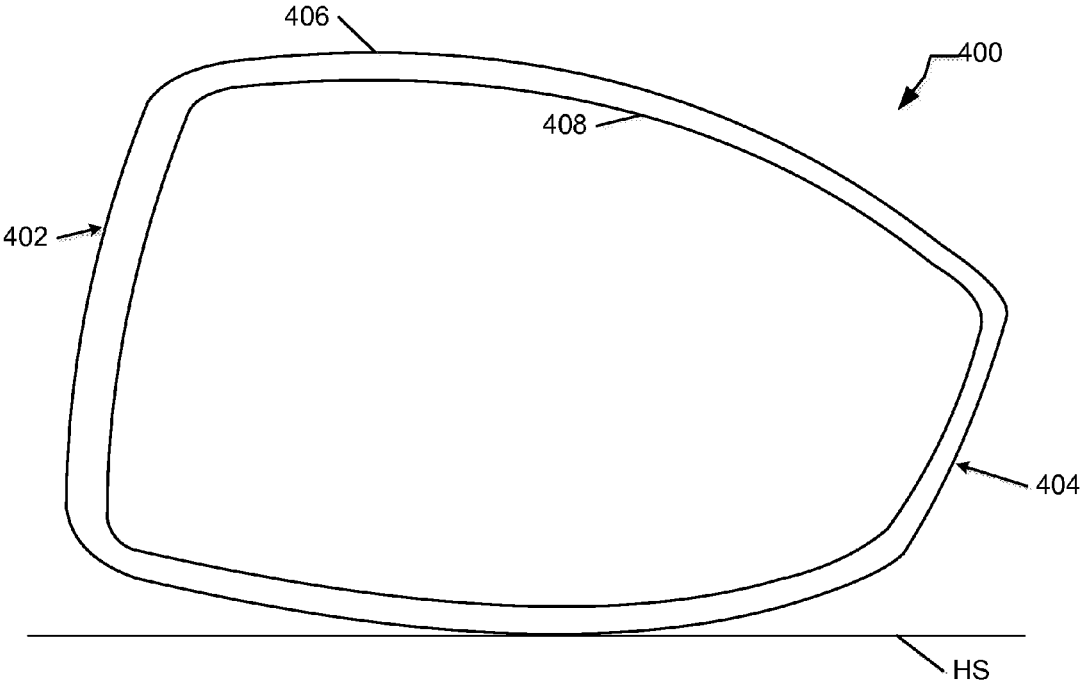
FIGS. 4A through 4P provide various views describing the design and manufacture of golf club heads and molds for making golf club head parts in accordance with at least some examples of this invention.

Club head design, tooling design (e.g., mold cavity designs), and methods of making golf club heads and club head parts in accordance with some examples of this invention will be described in more detail in conjunction with FIGS. 4A through 4P. FIG. 4A shows a cross sectional view of a desired golf club head 400, e.g., a vertical section along the club head's center of gravity in a front 402 to rear 404 direction. The club head 400 is oriented on a horizontal surface HS, optionally in a ball address orientation (e.g., in a position with the sole laying on the ground). At this point, the club head design simply shows this one desired cross sectional shape with an exterior surface 406 and an interior surface 408. While the club head 400 may constitute a physical sample or model at this stage, it also may be provided simply on a computer screen (e.g., as part of a CAD design for the club head). At this stage, the CAD design may have a complete and desired final three dimensional shape for the club head 402, including the ability to provide cross sectional views rotated along a central front-to-back direction of the club head.

At this stage, one may wish to complete more details of the desired club head design with an eye toward making the club head 400 from multiple parts that can be created using simpler manufacturing processes and tooling that is conventionally used in the golf club art (e.g., molding individual parts, optionally from polymeric materials, using relatively simple molds (e.g., no multi-part mold cores) and/or simple molding processes (e.g., one mold shot without changing plates, inserting plates, removing mold core parts, etc.). While some golf club heads according to this invention may have one part with the interior surface characteristics described above, optionally two or more (and optionally up to all parts) of the finished club head structure 400 will include parts with interior surfaces of the types described above (and in more detail below).

Figure 4B:
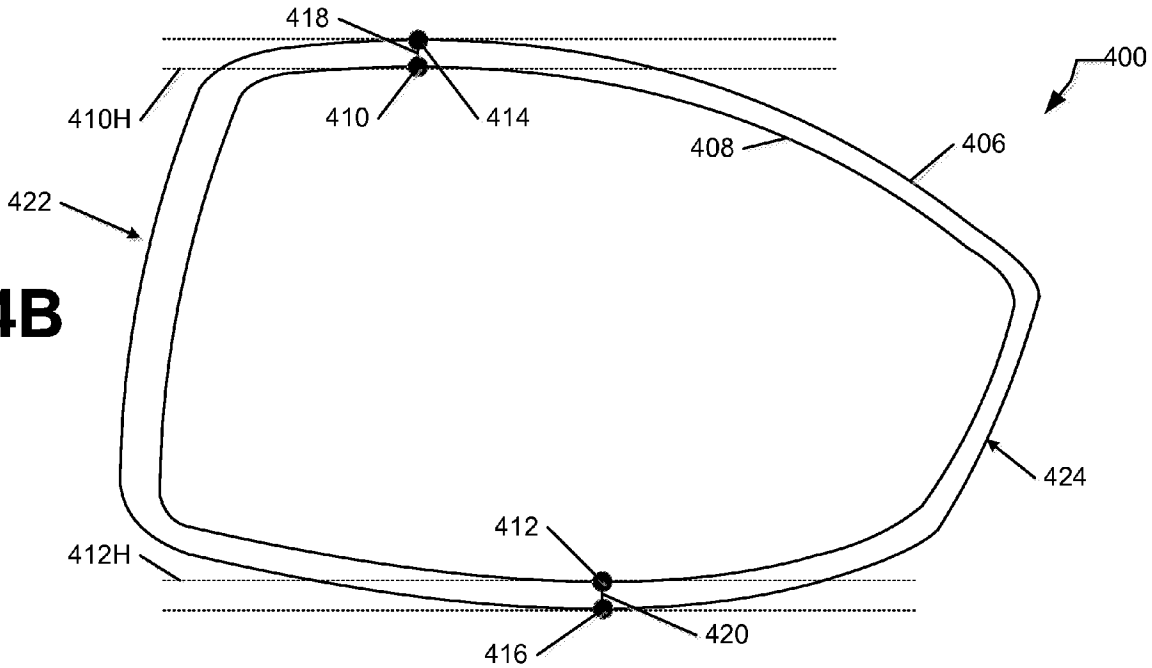

To continue with the design process, the design of FIG. 4A is taken and, as shown in FIG. 4B, the inflection points (or points where the slope of the interior surface 408 changes from an uphill slope to a downhill slope with respect to the orientation shown in FIGS. 4A and 4B) are determined. The inflection points also may be called "local minima" or "local maxima" points with respect to this orientation. This may be accomplished, for example, by finding a tangent point (or flat surface) at the uppermost surface and lowermost surface of the club head interior surface 408. See, for example, points 410 and 412, respectively, in FIG. 4B. These points 410 and 412 are identified by moving horizontal lines 410H and 412H to the highest and lowest tangent points on the interior surface 408. Inflection points of this type can be located all around the interior surface 408 of the club head 402 (e.g., by rotating the section plane around an axis extending through the club head's center in a front-to-back direction).

While not a requirement, inflection points of this type also may be identified on the exterior surface 406 of the club head 400 in generally the same manner (e.g., see points 414 and 416). Connecting the upper and lower inflection points at the top and bottom in this example provides locations for the parting line at that planar orientation (and similar parting line locations can be found for other planar orientations around the club head, as described above). The parting line location at this cross section is shown in FIG. 4B by line 418 connecting points 410 and 414 and line 420 connecting points 412 and 416. Alternatively, if desired, the lines 418 and 420 may be simply determined after the interior inflection points 410, 412 are determined, e.g., as vertical lines, as angled lines, as lines corresponding to an overlapping joint, etc. Similar lines of this type (418, 420) can be located all the way around the club head structure 402 (e.g., for other planar orientations, as described above) to thereby provide the location for the parting line around the club head 400. This feature divides the club head 400 into two parts, namely, forward part 422 and rearward part 424 at the local minima and maxima points on the interior surface 408.

Figure 4C:
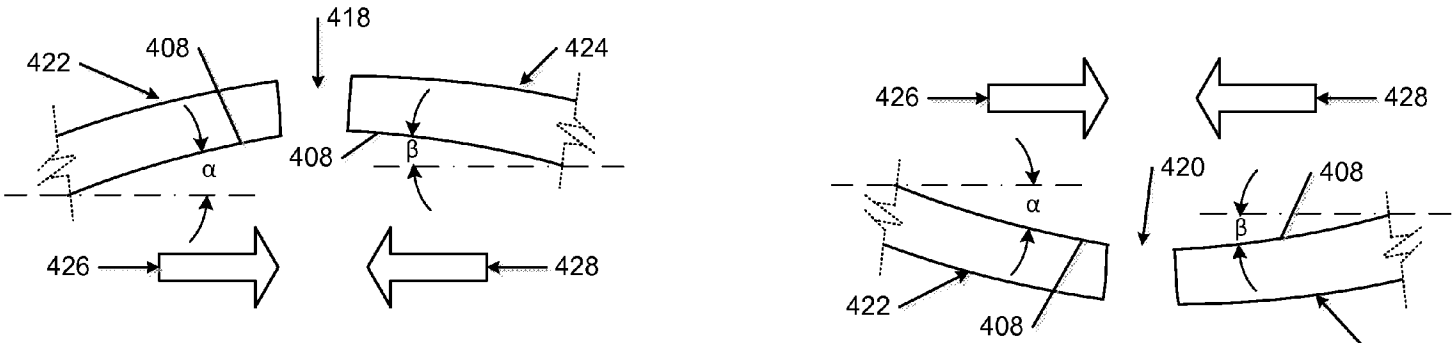
Figure 4D:
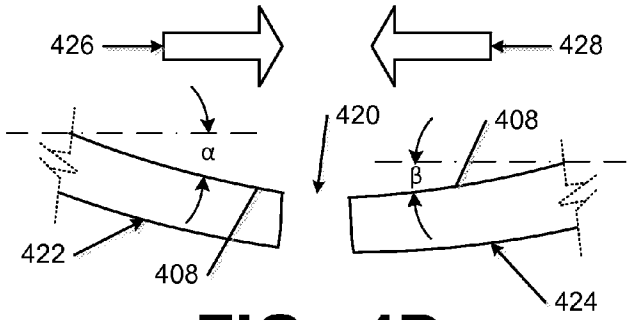

FIGS. 4C and 4D provide enlarged views of the junction area (e.g., at lines 418 and 420) between two separated parts 422 and 424 of a golf club head 400 designed as described above. By locating the junction areas at the local minima and maxima or inflection points around the interior surface 408 of the club parts, a positive draft angle α (or at least a neutral draft angle) for the interior surface 408 may be provided throughout that part. More specifically, as shown in FIGS. 4C and 4D, the angle α of the interior surface 408 of part 422 with respect to a pulling direction 426 for removal of a mold component for making part 422 is positive or neutral at all locations around the interior surface 408 of the part 422 as the interior surface 408 extends toward lines 418, 420. Similarly, as also shown in FIGS. 4C and 4D, the angle β of the interior surface 408 of part 424 with respect to a pulling direction 428 for removal of a mold component for making part 424 is positive or neutral at all locations around the interior surface 408 of the part 424 as the interior surface 408 extends toward lines 418, 420. Also, as described above, the interior surface 408 does not converge toward a center of the part 422 (or part 424) as the surface 408 moves in a direction toward the parting line area 418, 420 and/or the planar area enclosed and defined by the continuous interior surface 408 of part 422 (or part 424) does not decrease over any series of parallel planes moving in a direction toward the parting line area 418, 420.

In the views shown in FIGS. 4C and 4D, a "neutral draft angle" would constitute an angle α or β of 0° over at least some portions of the interior surface 408. In other words, in this illustrated example, a neutral draft angle would be provided at any locations where the interior surfaces 408 of parts 422, 424 are parallel to the mold pulling directions 426 and 428 shown in FIGS. 4C and 4D. An undesired negative draft angle would be provided if the interior surface 408 in FIG. 4C curved or moved downward in a direction moving toward parting line area 418 and/or if the interior surface 408 of FIG. 4D curved or moved upward moving in a direction toward parting line area 420. In those arrangements, the mold core could not be easily moved out of the interior volume of the parts 422 and 424 (at least not in a single, easy movement) because the mold cavity wall would be wider at some portion located further inside the interior volume of the parts 422, 424 (and thus would contact the molded part as the mold core moved outward). Interior surfaces with negative draft angles may be are made, if desired, using more complicated multi-part mold core structures (multiple parts that fit inside the interior volume of the molded part), more complicated mold core insertion and removal procedures, multi-step molding processes, and/or processes that involve more operator action or activity.

Figure 4E:
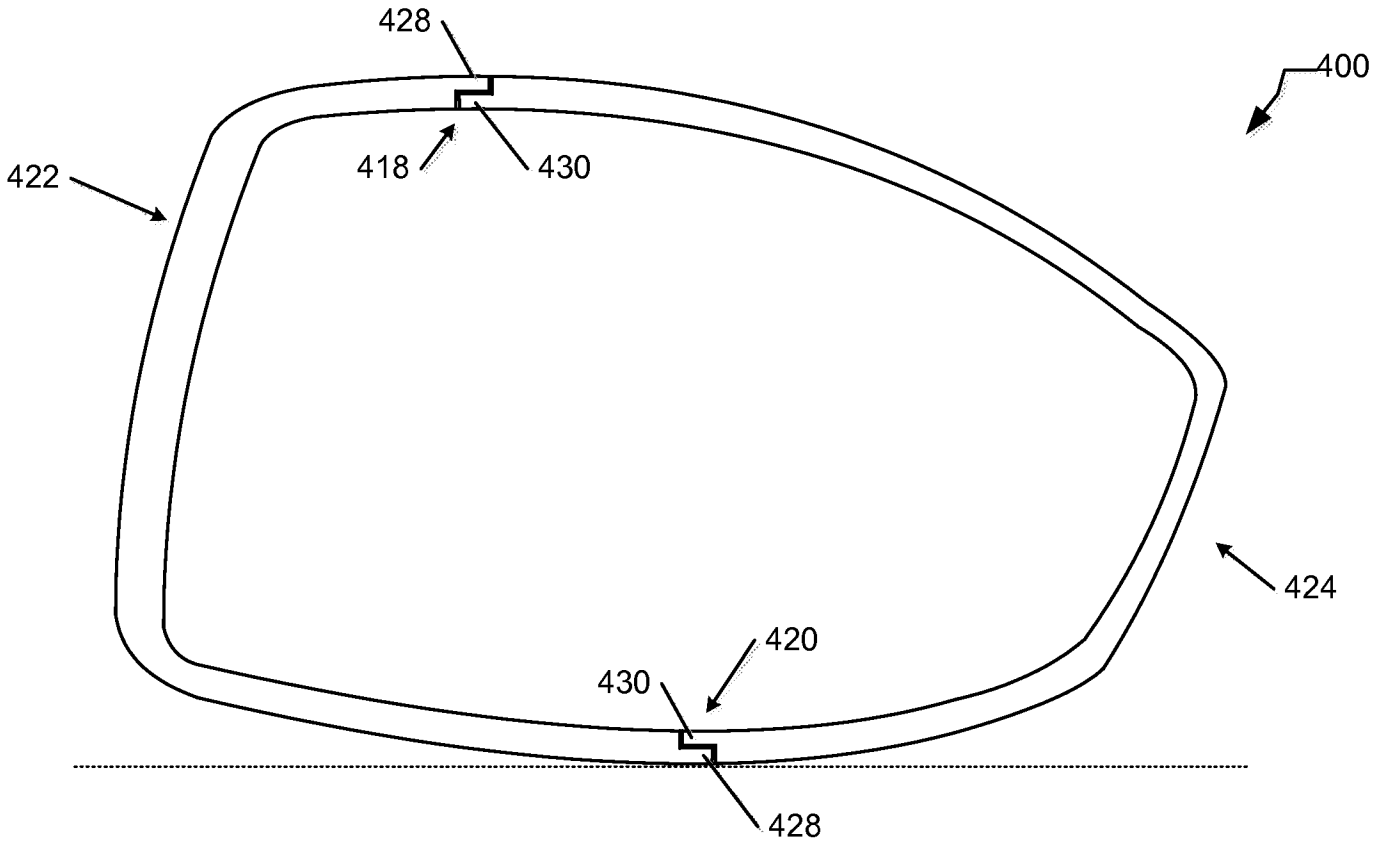
Figure 4F:
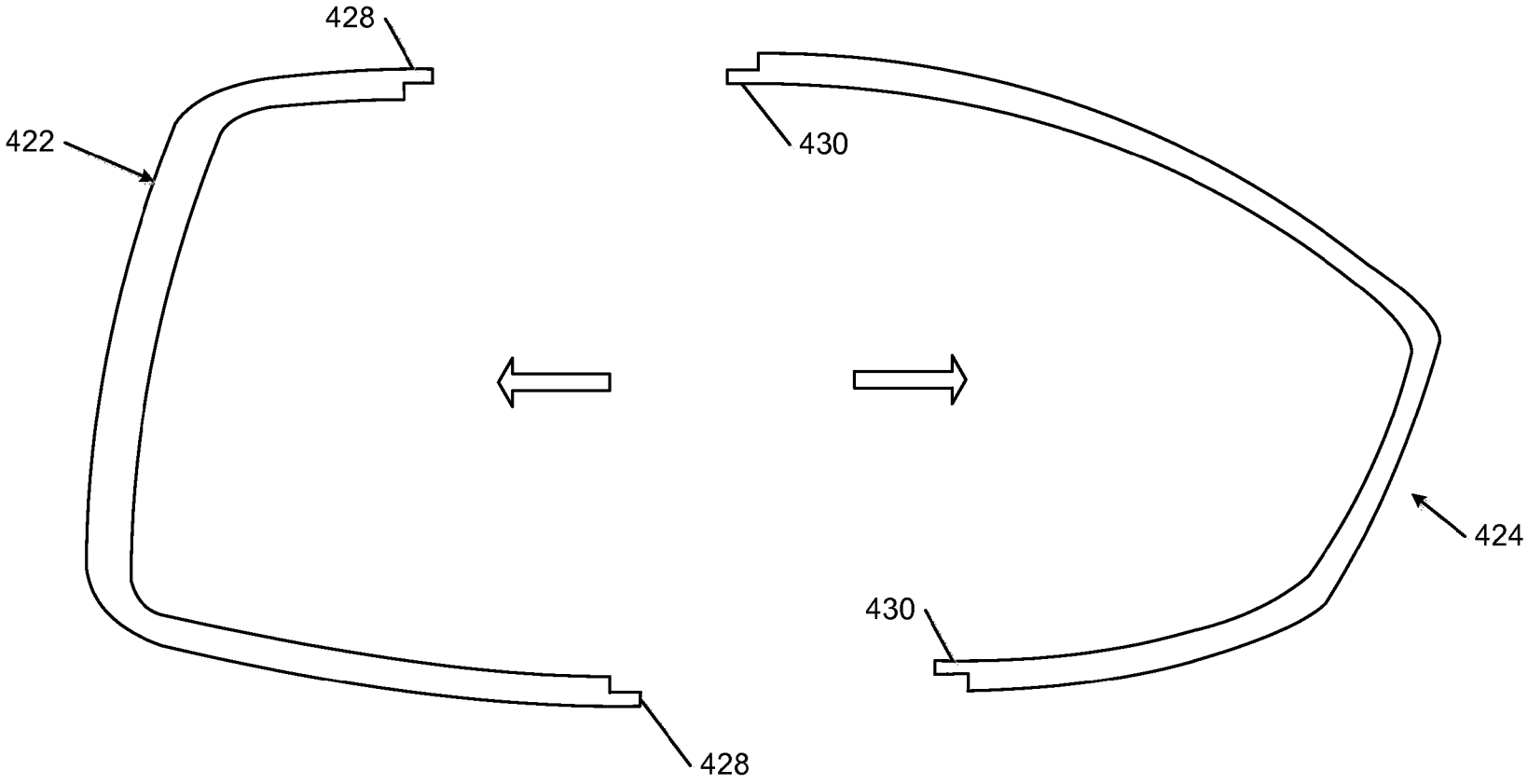

If desired, as shown in FIG. 4E, the parting line area 418, 420 may be modified to provide different structures for securing the two parts 422, 424, together (e.g., by cements or adhesives). More specifically, the parting line areas 418, 420 of this example have been altered to provide an overlapping or lap joint, with an extending outer ridge 428 of part 422 overlying an extending inner ridge 430 of part 424. Other types of joints or connecting features are possible without departing from this invention. While other arrangements may be possible (e.g., the ridges 428, 430 could be flipped vertically, made longer or shorter, made discontinuous, etc.), in this example, the overlapping joints are centered on the lines 418 and 420 determined in the step shown in FIG. 4B. FIG. 4F shows the club head 400 with the two parts 422, 424 separated.

Figure 4G:
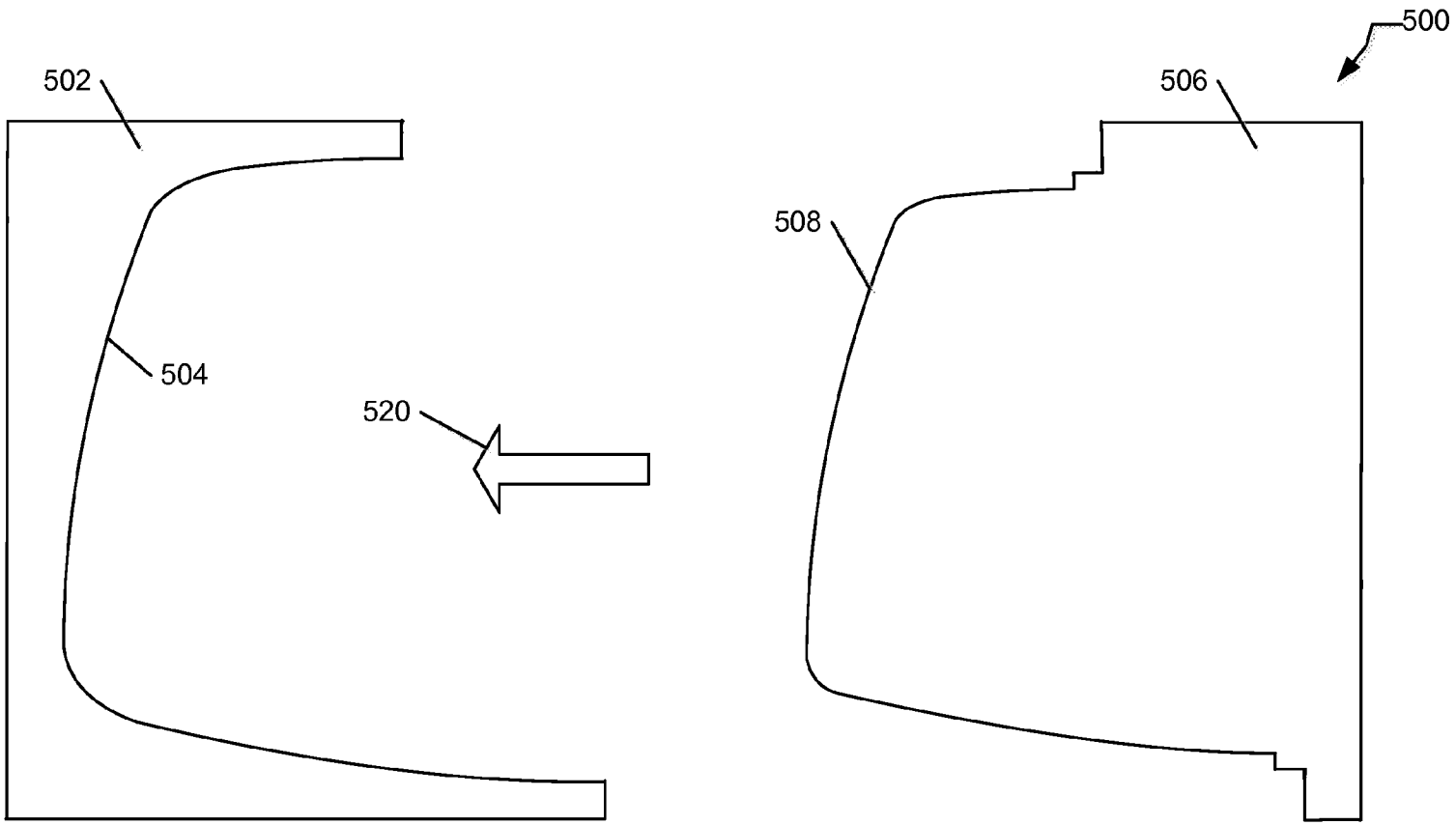

FIG. 4G shows features of the parts of an example two part mold 500 that may be used, for example, to make part 422 described above. As shown in FIG. 4G, mold part 502 includes a surface 504 against which at least most of the exterior surface 406 of the club head part 422 will be formed, and mold part 506 includes a surface 508 against which at least most of the interior surface 408 of the club head part 422 will be formed. The two mold parts 502, 506 may be moved together in any desired manner (e.g., by rotating one with respect to the other, by rotating both, by translational (e.g., linear or curved) movement of one or both parts, etc.), including in conventional manners as are known and used in this art. This movement is shown in FIG. 4G as translational movement by arrow 520. The mold parts 502, 506 may include guide elements and/or other features that assure proper seating and engagement of the mold parts 502, 506 with respect to one another. When properly positioned, as shown in FIG. 4H, the mold parts 502, 506 will define a mold cavity 510 between surfaces 504 and 508 in which the material for making the club head part (422) may be injected (or otherwise introduced). Injection of the moldable material (or other introduction of moldable material) is depicted in FIG. 4H by arrow 512.

Figure 4I:
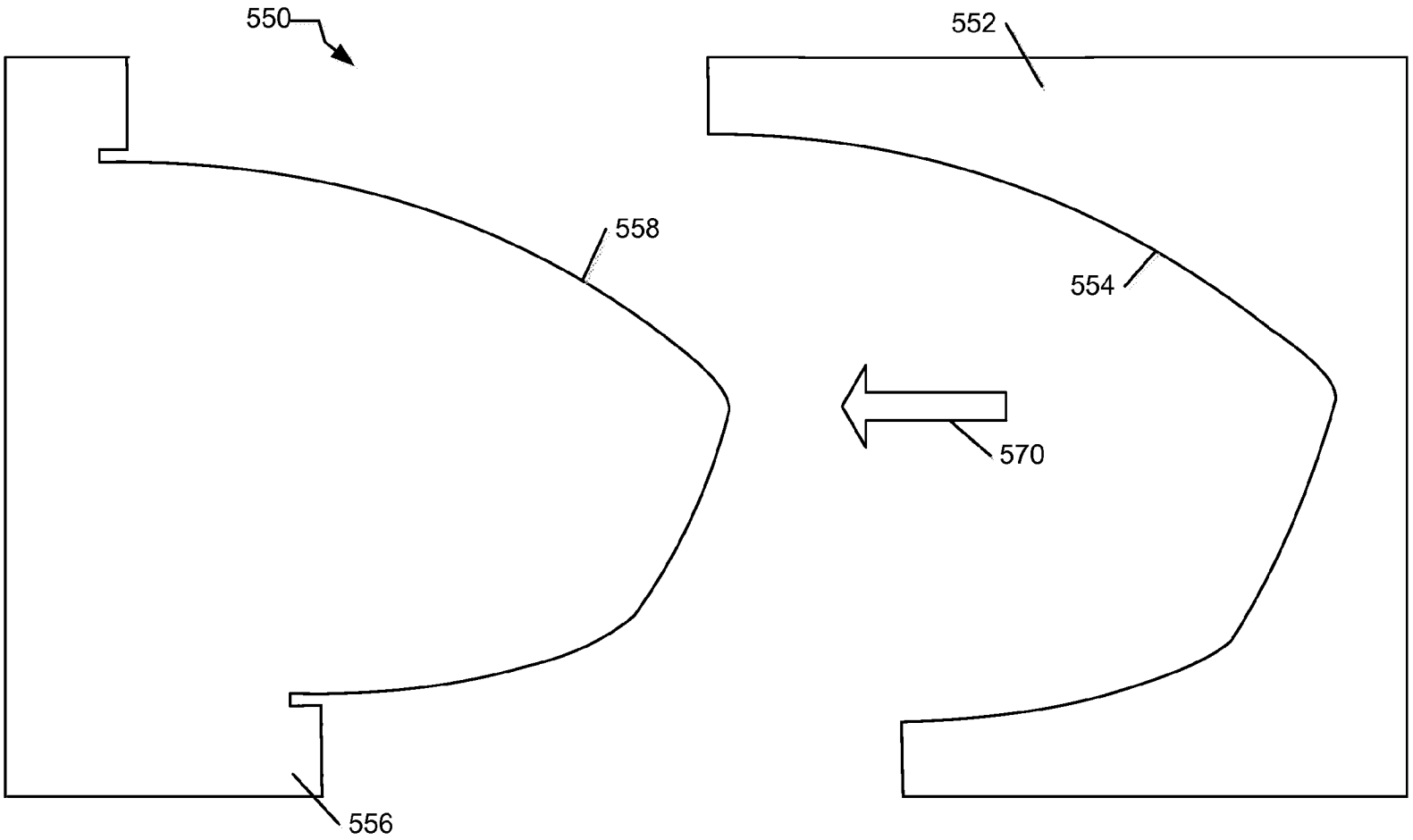
Figure 4J:
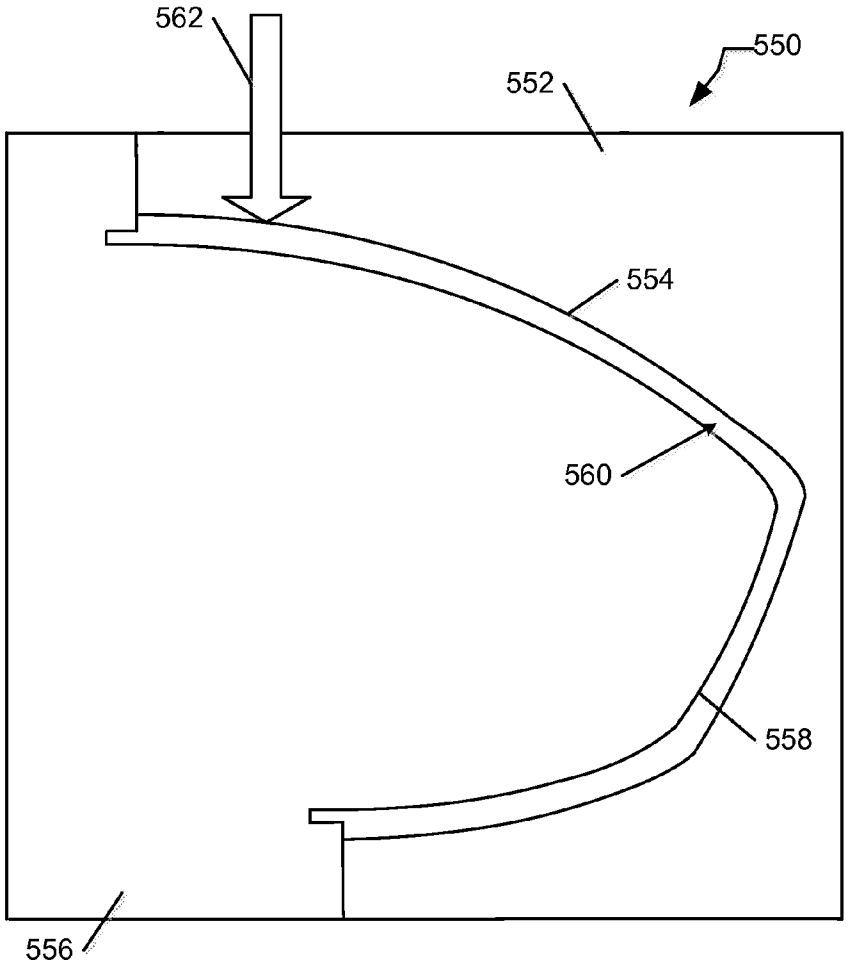
Figure 4H:
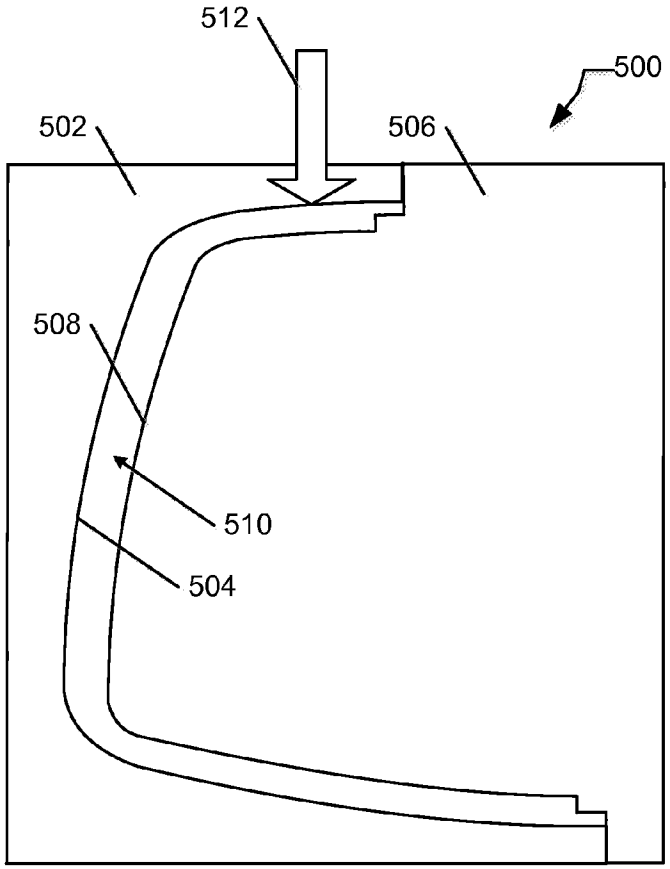

FIGS. 4I and 4J provide similar views for an example two part mold 550 that may be used, for example, to make part 424 described above. As shown in FIG. 4I, mold part 552 includes a surface 554 against which at least most of the exterior surface 406 of the club head part 424 will be formed, and mold part 556 includes a surface 558 against which at least most of the interior surface 408 of the club head part 424 will be formed. The two mold parts 552, 556 may be moved together in any desired manner (e.g., by rotating one with respect to the other, by rotating both, by translational (e.g., linear or curved) movement of one or both parts, etc.), including in conventional manners as are known and used in this art. This motion is illustrated in FIG. 4I as translation motion shown by arrow 570. The mold parts 552, 556 may include guide elements and/or other features that assure proper seating and engagement of the mold parts 552, 556 with respect to one another. When properly positioned, as shown in FIG. 4J, the mold parts 552, 556 will define a mold cavity 560 between surfaces 554 and 558 in which the material for making the club head part (424) may be injected (or otherwise introduced). Injection of the moldable material (or other introduction of moldable material) is depicted in FIG. 4J by arrow 562.

Figure 4K:
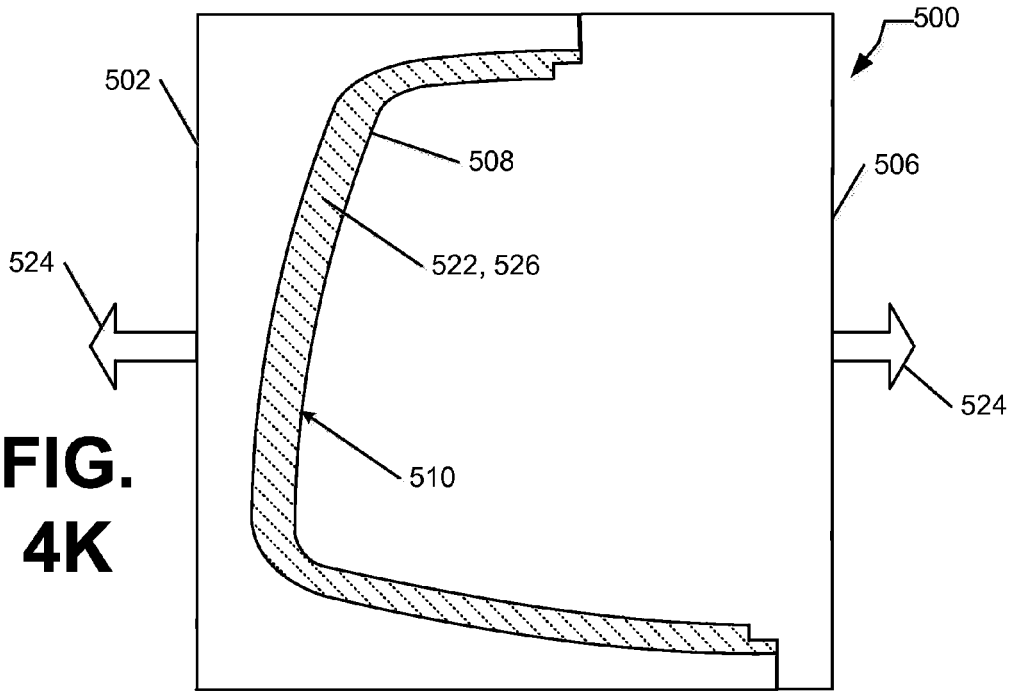
Figure 4L:
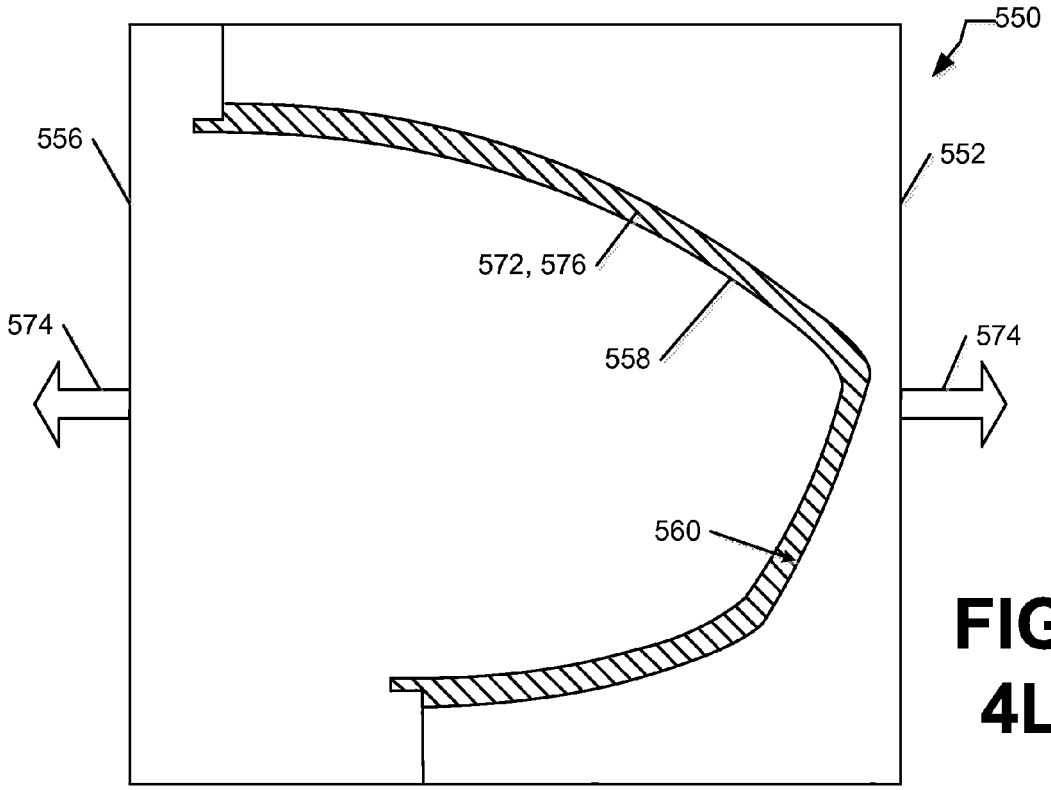

FIGS. 4K and 4L show the two mold assemblies 500, 550, respectively, after the interior cavities 510, 560 of the molds 500, 550 have been filled with a polymer (or other) material 522 and 572. While two different polymer materials 522, 572 are shown in FIGS. 4K and 4L, the same polymeric material, optionally having the same properties, may be used in each mold 500, 550, if desired (e.g., depending on the characteristics and/or need of the club head part being formed in that mold).

Figure 4M:
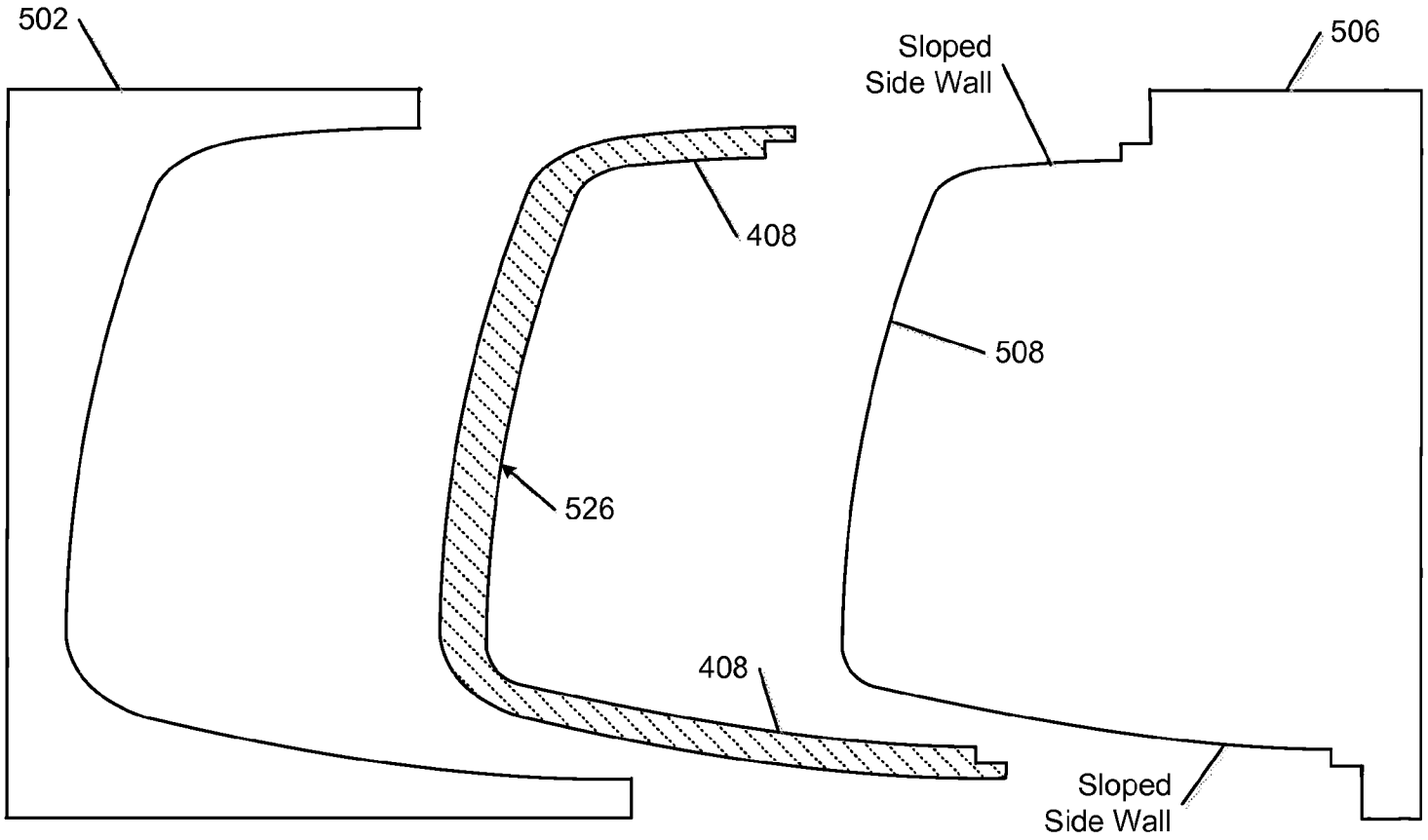

Once the molding procedure is completed (and optionally after the polymeric material 522 in the mold cavity 510 has partially or fully cured and/or has been further treated), the mold parts 502 and 506 (FIG. 4K) may be separated from one another (shown by arrows 524) to release the molded part 526 from the mold 500. This is where the interior surface features according to the invention, as described above, come into play. As shown in FIGS. 4K and 4M, because of the positive (or neutral) draft angle on the interior side walls of the mold cavity 510 as one moves in the mold pulling direction toward the junction between the mold parts 502 and 506 (with the mold pulling direction shown by right arrow 524 for mold part 506 in FIG. 4K), the interior wall 508 of mold part 506 forming the interior portion of the cavity 510 immediately pulls away from and spaces apart from the interior wall of part 526 at all locations around the part 526. Note how side walls 508 of cavity 510 slope in a constant direction (or remain horizontal or slanted outward in the view of FIGS. 4K and 4M) moving from an innermost location toward the mold junction area. If necessary or desired, one or more surface(s) of the mold cavity 510 may be treated with a release agent to prevent or reduce sticking of the molded part 526 to the cavity 510 walls 506, 508.

Figure 4N:
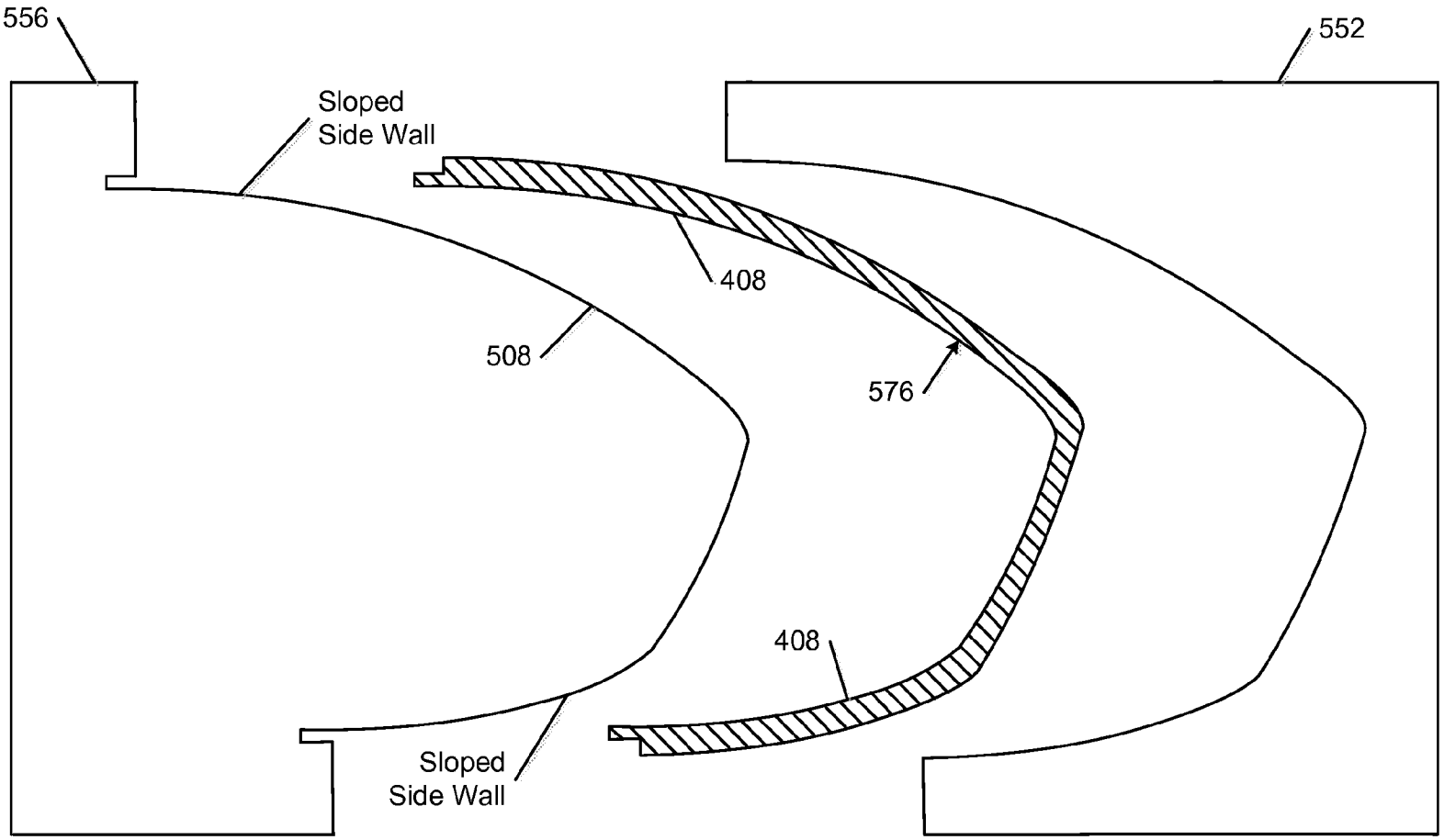

With respect to FIGS. 4L and 4N, once the molding procedure is completed (and optionally after the polymeric material 572 in the mold cavity 560 has partially or fully cured and/or has been further treated), the mold parts 552 and 556 (FIG. 4L) may be separated from one another (shown by arrows 574) to release the molded part 576 from the mold 550. This is where the interior surface features according to the invention, as described above, come into play. As shown in FIGS. 4L and 4N, because of the positive (or neutral) draft angle on the interior side walls of the mold cavity 560 as one moves in the mold pulling direction toward the junction between the mold parts 552 and 556 (with the mold pulling direction shown by left arrow 574 for mold part 556 in FIG. 4L), the interior wall 558 of mold part 556 forming the interior portion of the cavity 560 immediately pulls away from and spaces apart from the interior wall of part 576. Note how side walls 558 of cavity 560 slope in a constant direction (or remain horizontal or slanted outward in the view of FIGS. 4L and 4N) moving from an innermost location toward the mold junction area. If necessary or desired, one or more surface(s) of the mold cavity 560 may be treated with a release agent to prevent or reduce sticking of the molded part 576 to the cavity 560 walls 556, 558.

Figure 4O:
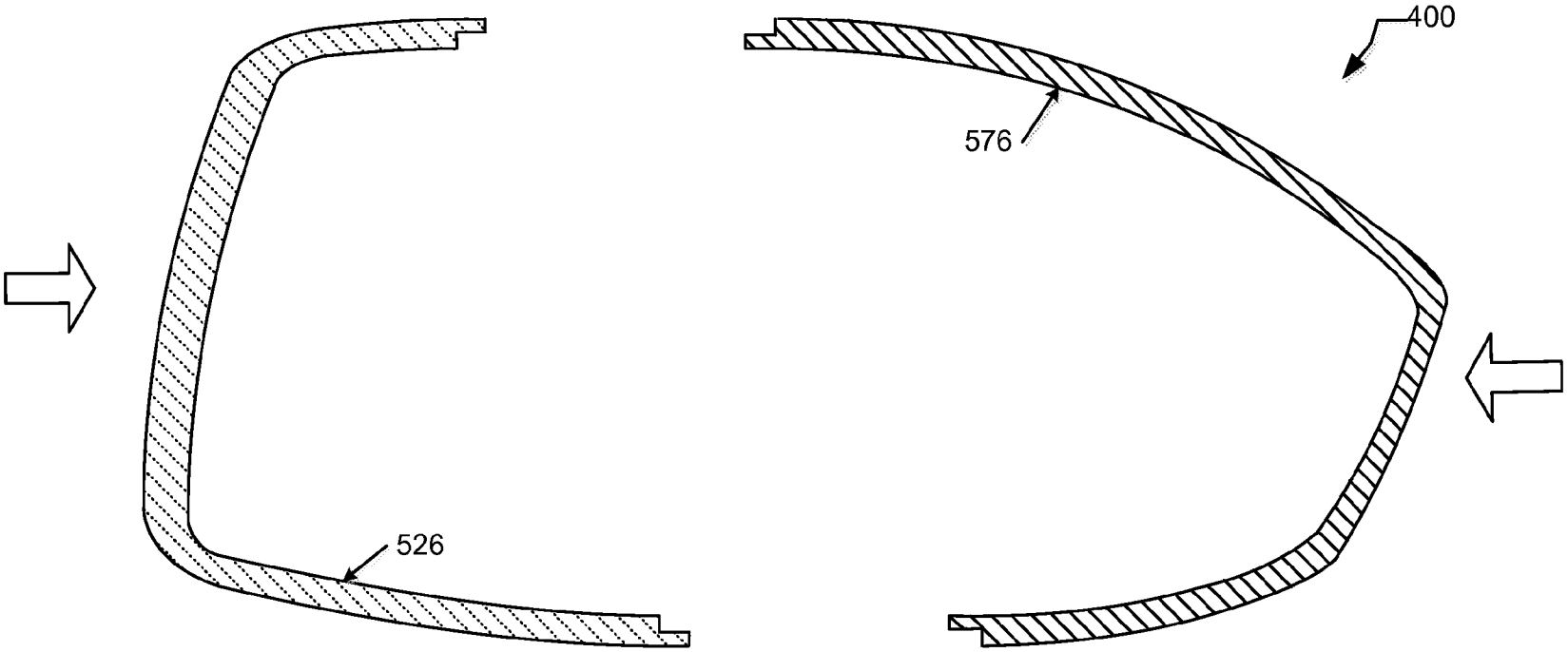
Figure 4P:
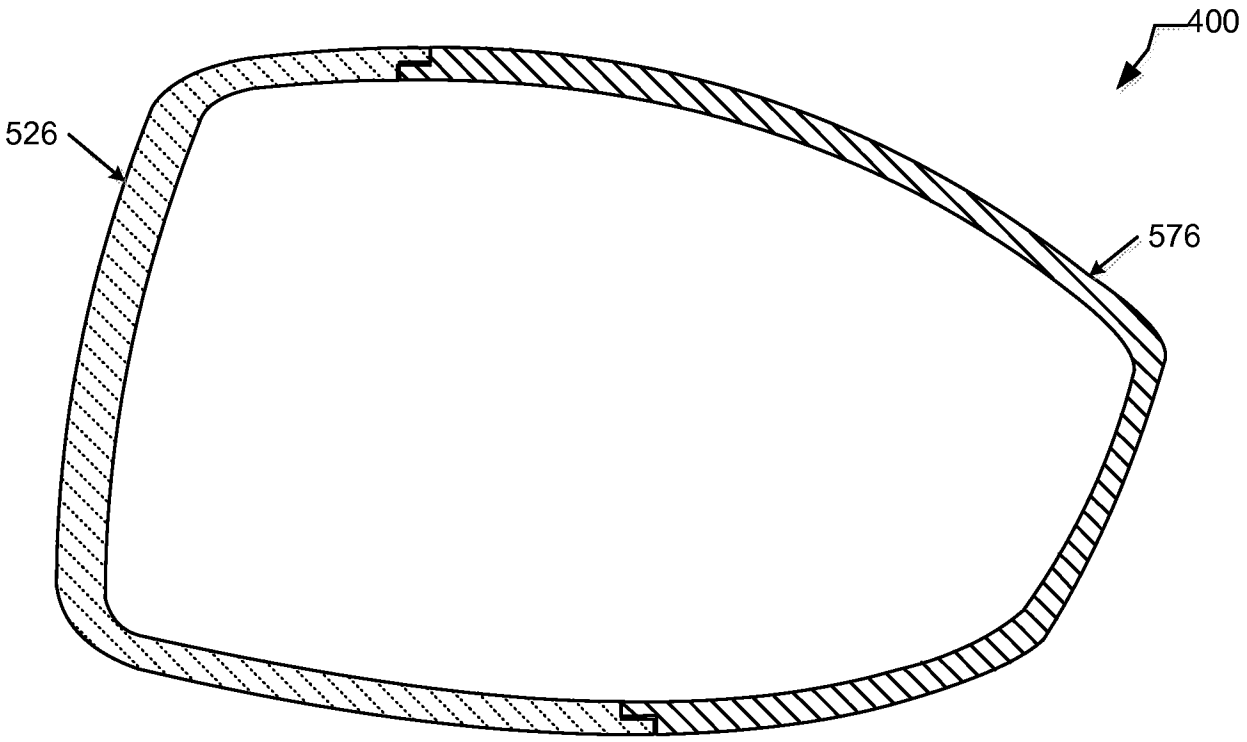

FIGS. 4O and 4P further show steps of assembling this example club head 400 from the molded parts 526, 576, formed as described above. As shown and mentioned above, these parts 526, 576 may be joined together in any desired manner without departing from this invention, including through the use of conventional techniques that are known and used in the art (e.g., cements and adhesives, mechanical fasteners, welding or other fusing techniques, etc.). Any additional post molding treatment or other changes also may take place, before or after the parts 526, 576 are assembled as shown in FIGS. 4O and 4P. Such treatments may include, for example: coating an exterior surface of one or more parts (e.g., with a nano coating of a metal material, as described in more detail below, with paint, with hardening agents, etc.); final curing of the molded parts 526, 576; grinding or machining one or more exterior surfaces (e.g., to include design features, logos, etc.); attaching one or more other club head parts (e.g., a cup face, ball striking face, or other face component, a sole plate, a medallion, etc.); attaching one or more weight elements (optionally in a releasable, adjustable, and/or interchangeable manner); etc.

While the mold structures illustrated in FIGS. 4G through 4N show a mold containing a single mold cavity, other designs (with multiple mold cavities in a single mold) are possible without departing from this invention, provided the walls of the mold cavity defining the interior surface of the molded parts in the multiple cavities have a positive (or neutral) draft angle in the mold pulling direction.

Figure 5A:
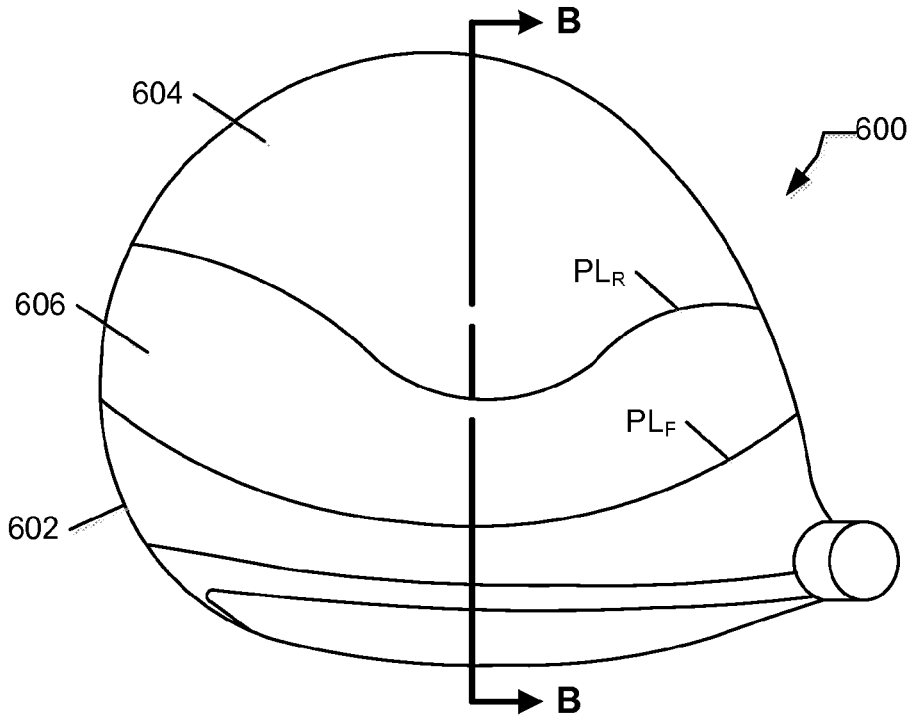
FIGS. 5A and 5B illustrate a multi-part golf club head having three parts and two complete and separate parting lines, wherein at least two of the three parts have interior surfaces with positive draft angles around the club head body.
Figure 5B:
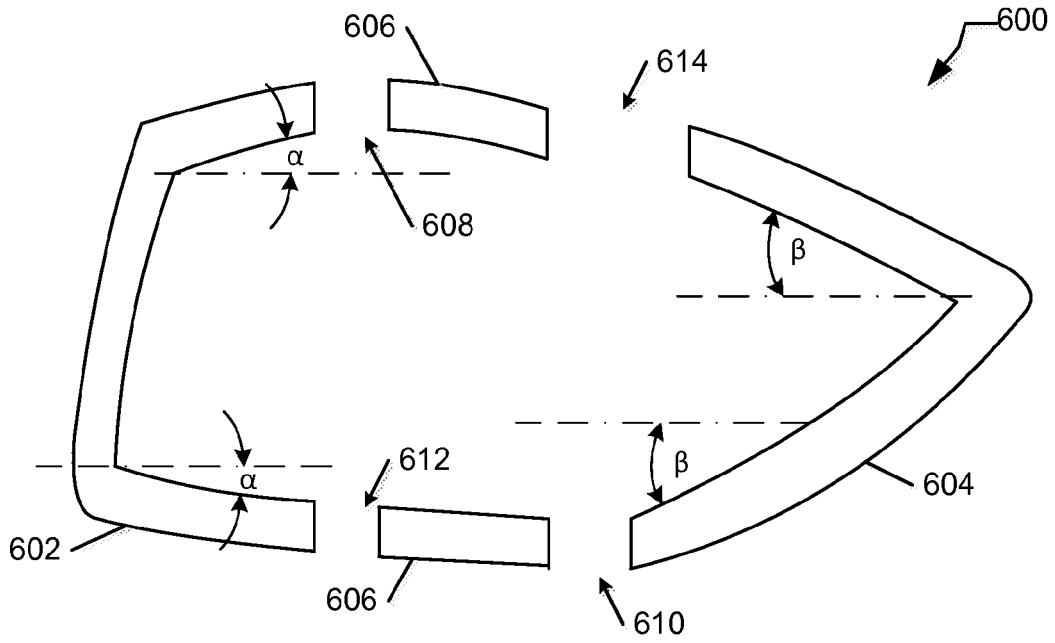

FIGS. 5A and 5B illustrate another example multi-part golf club head 600, this one with three separate parts moving in a front-to-back direction. The front part 602 (including a ball striking face or a base for supporting a separately attached ball striking face member (e.g., a striking plate or cup face)) and the rear part 604 of this example have positive draft angles α, β, respectively, on their interior surfaces, e.g., of the types described above. Each of the front part 602 and the rear part 604 of this example connects to an intermediate part 606 that forms a central body member of this example club head structure 600. Accordingly, this example club head 600 has two separate parting lines extending completely around the club head structure 600 in the top-to-bottom direction, namely, the forward parting line $PL_F$ and the rearward parting line $PL_R$.

At some areas of the club head 600, the intermediate part 606 may be located at slope change or inflection points on the overall interior surface of the club head 600. For example, as shown in FIG. 5B, in this example structure 600, the upper junction area 608 between front part 602 and intermediate part 606 is located at a slope change or inflection point of the upper interior surface of the club head 600. Similarly, the lower junction area 610 between the rear part 604 and the intermediate part 606 is located at a slope change or inflection point of the lower interior surface of the club head 600. At other areas of the club head 600, however, the interior surface of the intermediate part 606 may slope in the same direction as the interior surface of at least one of its connecting, adjacent parts. This is shown, for example, at the lower junction area 612 between the front part 602 and the intermediate part 606 (the lower interior surfaces of both parts 602 and 606 slope downward and rearward) and at the upper junction area 614 between the rear part 604 and the intermediate part 606 (the upper interior surfaces of both parts 604 and 606 slope upward and forward). Thus, in the club head structure 600 of FIGS. 5A and 5B, the forward parting line $PL_F$ follows a portion of an inflection point (or a local minima or maxima) of the interior club head surface at the junction of parts 602 and 606 and the rearward parting line $PL_R$ follows a portion of an inflection point (or local minima or maxima) of the interior club head surface at the junction of parts 604 and 606. At some points around its circumference, each parting line $PL_F$ and $PL_R$ transitions from a location at an inflection point (local minima or maxima) to a location on a continuous surface, slope, or angle.

Because both the bottom and top of the interior surface of the intermediate part 606 of this illustrated example structure 600 slopes downwardly and rearwardly, the interior surface of this part 606 does not include a neutral or positive draft angle around its entire interior perimeter surface. Therefore a mold structure somewhat different from those described above (or a different manufacturing method) may be needed to produce intermediate part 606.

Other options are possible for three part (or more part) golf club heads without departing from this invention. For example, if desired, the interior surface of the intermediate part 606 may have a neutral or one directional slope throughout its front to back length so that the interior surface of that part 606 also would have a neutral or positive draft angle over its entire interior surface (and could be made by tooling as described above).

Also, the intermediate part 606 need not extend completely around the club head body in the top-to-bottom direction. Rather, the intermediate part 606 may have a generally C-shape, L-shape, flat shape, curved shape, or the like. In such embodiments, the front part 602 and the rear part 604 may be connected directly together at some locations around the club head 600 (e.g., at the top and/or one or more sides, at the bottom and/or one or more sides, at the top only, at the bottom only, etc.) while the front part 602 and rear part 604 are separated by the intermediate part 606 at other locations around the club head 600. The parting line between the various club head parts of this type of structure may appear to split or branch at locations around the club head body where the intermediate part 606 begins and/or ends.

As noted above, in some golf club designs and structures according to this invention, the parting line at the exterior surface of the club head may be designed so as to be located at an inflection point (or local minima or maxima) of the exterior surface in the same manner that the parting line location is found for the interior surface (e.g., as described in conjunction with FIGS. 4A-4D). If desired, the entire exterior surface of one or more individual parts of a club head may have a positive draft angle in the same manner as the interior surface. This is not a requirement, however, in at least some example structures according to the invention. One reason that this is not as stringent of a requirement is due to the fact that, because the mold parts are located outside the surface of the molded part at all locations, there is space to more easily move (e.g., rotate, translate, etc.) parts of the mold structure for the exterior surface relative to one another. Because the mold surfaces for making the interior surface of the molded parts are at least partially located within a volume defined by the interior surface of the part, there is not sufficient room to within that volume to easily move (e.g., rotate, translate, etc.) individual portions of that mold part other than strictly in the designed mold pulling direction as described above.

Club head structures in accordance with some examples of this invention may include four or even more individual parts, provided at least one part has a positive (or neutral) draft angle throughout its interior surface as described above. In some embodiments, any number of the parts of the club head body (including two or more up to all of the parts) may have interior surfaces with positive (or neutral) draft angles around its interior surface as described above.

Another Example Embodiment

As described above, in some examples of this invention, the interior surfaces of two or more club head parts will have a neutral or positive draft angle, at least with respect to a pulling direction for a tool for making that part, as one moves toward an open edge of that part. In other example club heads in accordance with this invention, however, some negative draft angle may be tolerated, for at least some portions of the interior surface (e.g. around at least some portions of the interior surface in a perimeter direction and/or around at least some portions of the interior surface in a front-to-rear direction (e.g. in a mold tooling part pulling direction for producing the interior surface). At least some negative draft angle can be tolerated, for example, if the club head parts are sufficiently thin and/or flexible to allow them to be removed from the mold without damage even if a negative draft angle exists (at least over some portion of the interior surface). An individual club head part could have multiple, separated areas with negative draft angles, if desired.

Preferably, however, any negative draft angle area on the interior surface of the club head (e.g. an area having a negative angle for $\alpha$ and/or $\beta$ from FIGS. 4C and 4D) will have a relatively small negative draft angle and close to 0°, e.g. with $\alpha$ and/or $\beta$ between −1° and 0°, and in some examples between −0.5° and 0°, or even between −0.25° and 0°.

If a negative draft angle area exists on an interior surface of a golf club head part, any individual negative draft angle area will extend continuously for at least some distance: (a) in the perimeter direction around the interior surface (e.g.) like perimeter 302P in FIG. 3G) and (b) in the direction along the interior surface toward its open, free edge (e.g. in the mold tool pulling direction and/or the club part's depth dimension direction). Preferably, however, no single negative draft angle area will extend with the negative draft angle completely for any of these distances or dimensions. As some more specific examples, in accordance with some examples of this invention, no individual continuous area of the interior surface of a club head part having a negative draft angle will extend in the perimeter direction around the club head part for more than 50% of the perimeter length at that location. In some club heads, no individual continuous area of the interior surface of the club head part having a negative draft angle will extend in the perimeter direction for more than 25% of the perimeter length at that location, or even more than 10% or more than 5% of the perimeter length at that location. For club head parts having multiple, separated negative draft angle areas, preferably, the sum of the perimeter lengths of the negative draft angle areas around any given perimeter line (e.g. 302P) will be less than 50% and in some examples less than 25%, less than 10%, or even less than 5% of the total perimeter length of the club head interior surface at that location.

As another potential option or feature for at least some club head structures according to this invention, no individual continuous area of the interior surface of a club head part having a negative draft angle will extend in the perimeter direction around the club head part for more than 6 inches at that perimeter location (e.g. no more than 6 continuous inches around perimeter 302P of FIG. 3G). In some club heads, no individual continuous area of the interior surface of the part having a negative draft angle will extend in the perimeter direction more than 4 inches, more than 2 inches, or even more than 1 inch around the interior surface at that perimeter location. For club head parts having multiple, separated negative draft angle areas, preferably, the sum of the perimeter lengths of the negative draft angle areas around any given perimeter line (e.g., 302P) will be less than 6 inches, and in some examples, less than 4 inches, less than 2 inches, or even less than 1 inch.

As noted above, it is also preferable that no continuous negative draft angle area extend along the interior surface for the part's complete depth direction (e.g., in the mold tool pulling direction or otherwise in a direction toward the part's open edge). Preferably, however, no individual continuous area of the interior surface of a club head part having a negative draft angle will extend more than 50% of the part's depth dimension. In some club heads, no individual continuous area of the interior surface of the club head part having a negative draft angle will extend more than 25%, more than 10%, or even more than 5% of the part's depth dimension. The part's "depth dimension" is the maximum dimension from the parts open edge to its opposite end (e.g. see dimension "DEPTH" in FIGS. 2A-2D).

As another potential option or feature for at least some club head structures according to this invention, no individual continuous area of the interior surface of a club head part having a negative draft angle will extend in a direction that intersects the part's open edge (e.g. in the mold tool pulling direction) for more than 4 inches in that direction. In some club heads, no individual continuous area of the interior surface of the part having a negative draft angle will extend more than 2 inches, more than 1 inch, or even more than 0.5 inches in that direction (i.e., in a direction that intersects the open edge, such as a mold tool pulling direction). For club head parts having multiple, separated negative draft angle areas, preferably the sum of the lengths of the negative draft angle areas in any specific direction that intersects the open edge, such as a mold tool pulling direction, will be less than 4 inches, less than 2 inches, less than 1 inch, or even less than 0.5 inch.

Additional Potential Features of Club Heads

The two or more club head parts may be connected in any suitable way. For example, various adhesives may be used to join the two parts. Additionally or alternatively, the parts may be joined using screws or other mechanical fasteners. The two or more parts also may be connected via protrusions fitting into openings or grooves formed in the part structures. In still other arrangements, a snap-fit type arrangement may be used in which tabs, lips, etc., may be used to connect the rear part to the front part. Further, the front part may be bonded to the rear part during manufacture of the front part and the rear part.

The golf club head may accommodate weight members capable of being positioned at one or more locations on the club head structure. For example, weight ports may be included or attached to one or more club head parts to accept various weights depending on a desired configuration or weighting characteristic. Further, in golf club heads having a multiple piece arrangement, such as a golf club head having a front part and a rear part, the weight ports can be included in any one or any combination of two or more of the multiple pieces.

In some examples, a nano coating may cover at least some portions of the golf club head (including any one or more of the individual parts of the club head construction) and may aid in connecting the parts together. Nano coatings have been described as "liquid solids" composed of extremely small particles. The nano coatings may be extremely flexible, resistant to corrosion, abrasion or scratching, and may require substantially less time to cure than conventional coatings. For instance, some types of nano coatings may be cured in 10 seconds or less, as opposed to 30 minutes or more for various conventional coatings. The nano coating may be applied to the golf club head and/or individual parts thereof using known methods of application, such as painting, spraying, etc.

Particularly suited nano coating materials include fine-grained, high-strength pure metals or alloys containing one of Al, Cu, Co, Ni, Fe, Mo, Pt, Ti, W, Zn, and Zr; alloys containing at least two elements selected from Al, Cu, Ca, Ni, Fe, Mo, Pt, Ti, W and Zr; pure metals or alloys of Al, Cu, Co, Ni, Fe, Mo, Pt, W and Zr, further containing at least one element selected from Ag, Au, B, C, Cr, Mo, Mn, P, S, Si, Pb, Pd, Rh, Ru, Sn, V and Zn; and optionally containing particulate additions such as metal powders, metal alloy powders and metal oxide powders of Ag, Al, Co, Cu, In, Mg, Mo, Ni, Si, Sn, Pt, Ti, V, W, Zn; nitrides of Al, B and Si; C (graphite, carbon fibers, carbon nanotubes or diamond); carbides of B, Cr, Bi, Si, W; ceramics, glasses and polymer materials such as polytetrafluoroethylene (PTFE), polyvinylchloride (PVC), acrylonitrile-butadiene-styrene (ABS), polyethylene (PE), polypropylene (PP). In particular, suitable nano coatings may include those having Ni, Fe, Zn, and Co particles. The nano coating may further comprise a mixture of these particles.

The thickness of the applied coating may be any suitable thickness to achieve the desired look and properties of the coating. Suitable thicknesses range from 50 to 180 microns, and in some examples from 100 to 150 microns, or even from 120 to 130 microns. Further, the thickness could vary at different portions of the club head.

Nano coatings per se are known. Integran Technologies, Inc., for example, provides suitable nano coatings for various substrates. Suitable nano coatings, properties thereof, and methods of making nano coatings may be found in several Integran patents, for example, U.S. Pat. Nos. 7,387,578 and 7,910,224, and published applications, for example US 20110143159. These noted patents and applications are hereby incorporated by reference in their entirety.

As mentioned above, the nano coating may be an outer coating that may provide a uniform, one piece appearance for the golf club head (e.g., to cover the parting line(s)). In some arrangements, the nano coating may provide the appearance of a golf club head made entirely of metal or another single material.

The nano coating covering all or substantially all of the golf club head may affect the feel of the club during use. For instance, the nano coating may provide a softer feel or a harder feel during a golf swing and contact with a ball based on the type of nano coating used (e.g., the type of particles within the nano coating). Thus, golf club designers may select a type of nano coating based on the desired feel or performance characteristics of the golf club head. Further, the center of gravity, moment of inertia, flex point, swingweight, and the like may be manipulated through the use of a nano coating via selection of the materials of the nano coating as well as strategic positioning of the coating. The nano coating material also may affect the sound produced when a golf club head according to the invention contacts a ball.

In addition to coating the club head, the nano coating may be applied to all or part of the shaft as well. For example, the shaft and club head may be formed together such as being made from polymer, composite materials etc. in a single, unibody construction. The nano coating may then be applied to the entire golf club. This provides the ability to manipulate properties of the entire golf club such as center of gravity, moment of inertia, flex point, swingweight, and the like.

As discussed, in certain embodiments of the invention, the golf club head may have a front part and a rear part optionally made from different materials or materials having different densities. For example, in one embodiment, the front part may be made from a first material that is a dense material. A rear part may be made from a second material that is less dense than the first material. The front part and the rear part may be connected or otherwise joined together to form the golf club head. The portions cooperatively define a volume of the golf club head. In one embodiment, the front part that is denser may constitute approximately 40% of the volume of the club head, and the rear part that is less dense may constitute approximately 60% of the volume of the club head. In another embodiment, the front part that is denser may constitute approximately 30% of the volume of the club head, and the rear part that is less dense may constitute approximately 70% of the volume of the club head. In certain embodiments, the front part may be a metal material (or coated with a metal material) and the rear part may be a polymer material (optionally uncoated) although other materials may be used, e.g., based on density and/or other properties.

The density of portions of the golf club head may be manipulated depending on desired characteristics of the golf club head. For example, the center of the face may be formed of a high density material corresponding to the ball striking area whereas other aspects of the golf club head may be formed of a low density material. The hosel may be made of a low density material to allow higher density material in other areas but keep a balance of total weight of the golf club head. Such strategic placement of various density materials, such as to localize such materials, can allow manipulation of the center of gravity and/or ball speed, as well as other properties. Such manipulations may affect ball speed for example. The nano-coating may be applied to the entire overall surface area of the club head as discussed herein.

IV. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 5B may be used individually and/or in any combination or subcombination without departing from this invention.

What is claimed is:

1. A golf club head, comprising:

a first part that forms a front part of the golf club head including a first side wall extending around the golf club head, wherein the first side wall ends at a first edge that defines an open side of the first part, and wherein a first interior surface of the first side wall has a draft angle of 0° or more, with respect to a first pulling direction as the first interior surface extends in a direction toward the first edge;

a second part that forms a rear part of the golf club head including a second side wall extending around the golf club head, wherein the second side wall ends at a second edge that defines an open side of the second part, and wherein a second interior surface of the second side wall has a draft angle of 0° or more, with respect to a second pulling direction, as the second interior surface extends toward the second edge, a third part that forms a central body member of the golf club head including a third side wall extending around the golf club head, wherein the third side wall ends at a third edge that defines a first open side of the third part positioned toward the front part of the golf club head, and wherein a third interior surface of the third side wall has a draft angle of 0° or more, with respect to a third pulling direction, as the third interior surface extends toward the third edge; and wherein the third part includes a fourth edge defining a second open side of the third part positioned toward the rear part of the golf club head;

wherein the first part and the third part are engaged with one another over at least a portion of the first edge and at least a portion of the third edge, and wherein the second part and the third part are engaged with one another over at least a portion of the second edge and at least a portion of the fourth edge, and wherein the second part and the third part form a second parting line having a contoured sinusoidal curvature with a forward protruding section near a heel-to-toe center of a crown of the golf club head with a concave shape relative to the front part of the golf club head.

2. The golf club head according to claim 1, wherein the first pulling direction and the second pulling direction are not parallel.

3. The golf club head according to claim 1, wherein the first part and the second part are molded parts.

4. The golf club head according to claim 3, wherein the third part is a molded part.

5. The golf club head according to claim 1, wherein the third part has a C-shape.

6. The golf club head according to claim 1, wherein the first part includes at least a portion of a ball striking face member of the golf club head at a location opposite the first edge, and wherein the second part includes a closed end opposite the second edge.

7. The golf club head according to claim 1, wherein the draft angle of the first interior surface is greater than 0°, and wherein the draft angle of the second interior surface is greater than 0°.

8. The golf club head according to claim 1, wherein the first part engages the third part with a lap joint, and wherein the second part engages the third part with a lap joint.

9. A golf club head, comprising:

a first part that forms a front part of the golf club head including a first side wall extending around the golf club head, wherein the first side wall ends at a first edge that defines an open side of the first part, and wherein a first interior surface of the first side wall has a draft angle of 0° or more, with respect to a first pulling direction, as the first interior surface extends in a direction toward the first edge;

a second part that forms a rear part of the golf club head including a second side wall extending around the golf club head, wherein the second side wall ends at a second edge that defines an open side of the second part, wherein a second interior surface of the second side wall has a draft angle of 0° or more, with respect to a second pulling direction, as the second interior surface extends in a direction toward the second edge, a third part that forms a central body member of the golf club head including a third side wall extending around the golf club head, wherein the third side wall ends at a third edge that defines a first open side of the third part positioned toward the front part of the golf club head, and wherein a third interior surface of the third side wall has a draft angle of 0° or more, with respect to a third pulling direction, as the third interior surface extends toward the third edge;

wherein the third part includes a fourth edge defining a second open side of the third part positioned toward the rear part of the golf club head;

wherein the third part is engaged with the first part over at least a portion of the first edge to thereby form at least a portion of a first parting line;

wherein the second part and the third part are engaged with one another over at least a portion of the second edge to thereby form at least a portion of a second parting line having a contoured sinusoidal curvature with a forward protruding section near a heel-to-toe center of a crown of the golf club head with a concave shape relative to the front part of the golf club head; and wherein the first part and second part are molded parts.

10. The golf club head according to claim 9, wherein the first parting line extends completely around the golf club head.

11. The golf club head according to claim 9, wherein the first pulling direction and the second pulling direction are not parallel.

12. The golf club head according to claim 9, wherein the first parting line is non-linear.

13. The golf club head according to claim 9, wherein the third part is a molded part.

14. The golf club head according to claim 9, wherein the first part engages the third part with a lap joint, and the second part engages the third part with a lap joint.

15. A golf club head, comprising:

a first part that forms a front part of the golf club head including a first side wall extending around the golf club head, wherein the first side wall ends at a first edge that defines an open side of the first part, and wherein a first interior surface of the first side wall has a draft angle of 0° or more, with respect to a first pulling direction as the first interior surface extends in a direction toward the first edge;

a second part that forms a rear part of the golf club head including a second side wall extending around the golf club head, wherein the second side wall ends at a second edge that defines an open side of the second part, and wherein a second interior surface of the second side wall has a draft angle of 0° or more, with respect to a second pulling direction, as the second interior surface extends toward the second edge, a third part that forms a central body member of the golf club head including a third side wall, wherein the third side wall ends at a third edge that defines a first open side of the third part positioned toward the front part of the golf club head, and wherein a third interior surface of the third side wall has a draft angle of 0° or more, with respect to a third pulling direction, as the third interior surface extends toward the third edge;

wherein the third part includes a fourth edge defining a second open side of the third part positioned toward the rear part of the golf club head;

wherein the first part and the third part are engaged with one another over at least a portion of the first edge and at least a portion of the third edge;

wherein the second part and the third part are engaged with one another over at least a portion of the second edge and at least a portion of the fourth edge, and wherein the second part and the third part form a second parting line having a contoured sinusoidal curvature with a forward protruding section near a heel-to-toe center of a crown of the golf club head with a concave shape relative to the front part of the golf club head when engaged with one another; and wherein the first part and the second part are engaged with one another over at least a portion of the first edge and at least a portion of the second edge.

16. The golf club head according to claim 15, wherein the first part and the second part are molded parts.

17. The golf club head according to claim 16, wherein the third part is a molded part.

18. The golf club head according to claim 15, wherein the first part engages the third part with a lap joint, the second part engages the third part with a lap joint, and the first part engages the second part with a lap joint.

* * * * *